US007013098B2

(12) United States Patent
Hosoi et al.

(10) Patent No.: US 7,013,098 B2
(45) Date of Patent: Mar. 14, 2006

(54) IMAGE FORMING APPARATUS

(75) Inventors: Ken-ichi Hosoi, Tokyo (JP); Minoru Asakawa, Tokyo (JP); Takaaki Sakai, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 81 days.

(21) Appl. No.: 10/845,234

(22) Filed: May 14, 2004

(65) Prior Publication Data

US 2005/0047813 A1 Mar. 3, 2005

(30) Foreign Application Priority Data

Sep. 1, 2003 (JP) ..... 2003-309181

(51) Int. Cl.
*G03G 15/00* (2006.01)

(52) U.S. Cl. ..... 399/87

(58) Field of Classification Search ..... 358/401, 358/296; 399/82, 81, 83, 85, 87
See application file for complete search history.

(56) References Cited

U.S. PATENT DOCUMENTS 6,483,999 B1 * 11/2002 Andersen et al. ..... 399/87
6,924,826 B1 * 8/2005 Nakagiri et al. ..... 715/700

FOREIGN PATENT DOCUMENTS

JP 10-026905 1/1998
JP 2001-010169 1/2001

* cited by examiner

*Primary Examiner*—Hoang Ngo
(74) *Attorney, Agent, or Firm*—Finnegan, Henderson, Farabow, Garrett & Dunner, L.L.P.

(57) ABSTRACT

The present invention is to provide an image forming apparatus including: automatic document feeding means for placing multiple originals in position and feeding the originals one by one; document reading means; printing means for printing on paper image data acquired by the reading means; document detecting means, provided in the automatic document feeding means, for detecting the originals; paper detecting means for detecting paper; operation means for capturing user's operations; and control means for receiving an interrupt operation instruction given by the user through the operation means, determining executable operation modes according to the transport states of the originals and paper detected by the document detecting means and the paper detecting means, and outputting the executable operation mode selected through the operation means.

6 Claims, 20 Drawing Sheets

IMAGE FORMING APPARATUS

BACKGROUND OF THE INVENTION

1. Field of the Invention

The present invention relates to an image forming apparatus for reading image data from a source or original document, and printing the document image on recording paper (hereinafter simply called paper).

2. Description of the Related Art

Some kinds of image forming apparatuses, such as copying machines, incorporate a function, called an interrupt mode, for suspending processing currently in progress and performing another processing. Many of recent image forming apparatuses incorporate an automatic document feeder (ADF) in which multiple originals are placed and fed one by one for reading of image data. Suppose that one or more unread originals (interrupted job originals) remain in the automatic document feeder upon execution of another processing in an interrupt mode. In this case, the use of the automatic document feeder in the interrupt mode causes a mix-up between the precedent interrupted job originals and interrupt job originals. To avoid this, any conventional way of setting an interrupt mode is to prohibit users from selecting any mode with the potential to go into competition with the interrupted job.

For example, there are techniques for making the transition to the interrupt mode in such a way that allows the execution of the interrupt job only after a number of copies set for the interrupted job are completed (for example, refer to Japanese patent laid-open No. 10-026905). There is also another type of techniques for competition control and warning upon setting of an interrupt job. When setting of an interrupt mode leads to processing competition, this type of techniques provides a warning indication to urge the user to change the setting (for example, refer to Japanese patent laid-open No. 2001-010169).

Thus there is no conventional image forming apparatus that can determine, based on the results of checking the states of originals and paper in response to a request to execute an interrupt mode, which operation mode to select from those usable in the interrupt mode. In other words, since the conventional image forming apparatuses have previously eliminated operation modes with the potential to go into processing competition, operation modes executable in an interrupt mode are limited upon setting the interrupt mode. This makes the conventional image forming apparatuses less user-friendly.

SUMMARY OF THE INVENTION

The present invention has been made to solve the above conventional problem, and it is an object thereof to provide an image forming apparatus capable of increasing the number of operation modes executable in an interrupt mode.

To attain the object, in the first aspect of the present invention, there is provided an image forming apparatus comprising: automatic document feeding means for placing multiple originals in position and feeding the originals one by one; document reading means; printing means for printing on paper image data acquired by the reading means; document detecting means, provided in the automatic document feeding means, for detecting the originals; paper detecting means for detecting paper; operation means for capturing user's operations; and control means for receiving an interrupt operation instruction given by the user through the operation means, determining executable operation modes according to the transport states of the originals and paper detected by the document detecting means and the paper detecting means, and outputting the executable operation mode selected through the operation means.

In the second aspect of the present invention, the image forming apparatus as set forth in the first aspect of the present invention is such that, when an interrupt operation is instructed by the user while the originals are being fed by the automatic document feeding means, the control means completes the reading of the original being currently fed and stops the feeding of the following originals.

In the third aspect of the present invention, the image forming apparatus as set forth in the first aspect of the present invention is such that, when determining that there are no originals in the automatic document feeding means based on the detection result of the document detecting means, the control means enables the selection of an operation mode using the automatic document feeding means, while when determining there is one or more originals in the automatic document feeding means, the control means disables the selection of the operation mode using the automatic document feeding means.

In the fourth aspect of the present invention, the image forming apparatus as set forth in the first aspect of the present invention is such that, when an interrupt operation is instructed by the user while the originals are being fed by the automatic document feeding means, the control means not only completes the reading of the original being currently fed, but also feeds the following originals while counting the number of unread originals, and when determining that there are no originals in the automatic document feeding means based on the detection result of the document detection means, the control means enables the selection of an operation mode using the automatic document feeding means and outputs all pieces of originals corresponding to the number of unread originals to the operation means after completion of the interrupt operation.

In the fifth aspect of the present invention, the image forming apparatus as set forth in the first aspect of the present invention further comprises post processing means including at least stacking means for stacking sheets of paper on which printing have been done through the printing means, and binding means for binding the sheets of paper stacked on the stacking means, in which the paper detection means detects the presence or absence of paper in the post processing means, and when determining no paper in the post processing means based on the detection result of the paper detection means, the control means enables the selection of an operation mode using the post processing means, while when determining there is one or more sheets of paper in the post processing means, the control means disables the selection of the operation mode using the post processing means.

In the sixth aspect of the present invention, the image forming apparatus as set forth in the first aspect of the present invention further comprises reversing means for turning the paper upside down, in which the paper detection means detects the presence or absence of paper in the reversing means, and when determining no paper in the reversing means based on the detection result of the paper detection means, the control means enables the selection of an operation mode using the reversing means, while when determining there is one or more sheets of paper in the reversing means, the control means disables the selection of the operation mode using the reversing means.

In the image forming apparatus according to the present invention, the automatic document feeding means places originals in position and feeds them one by one to the reading means. The reading means acquires image data from each of the originals fed by the automatic document feeding means. The printing means prints on paper the image data acquired by the reading means, thus copying the document image onto paper.

During the above-mentioned copying operation, when an interrupt request is received from the user through the operation means, the control means controls the document detection means and the paper detection means to detect in what units the original and paper transported in the interrupted job (the copying operation in progress) are located. The control means outputs such an operation display screen to the operation means as to enable the selection of operation modes using units that are not being used in the interrupted job and disable the selection of operation modes using units that are used in the interrupted job. It enables the user to select an operation mode easily for sure in the interrupt operation.

It is apparent from the above description that the present invention is such that, when an interrupt request is made by a user's operation, executable operation modes are automatically determined according to the transport states of originals and paper in the interrupted job to enable the user to select an operation mode, so that the operation mode executable in the interrupt mode can be selected without any competition with the interrupted job, thus improving the convenience of users.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

Figure 1:
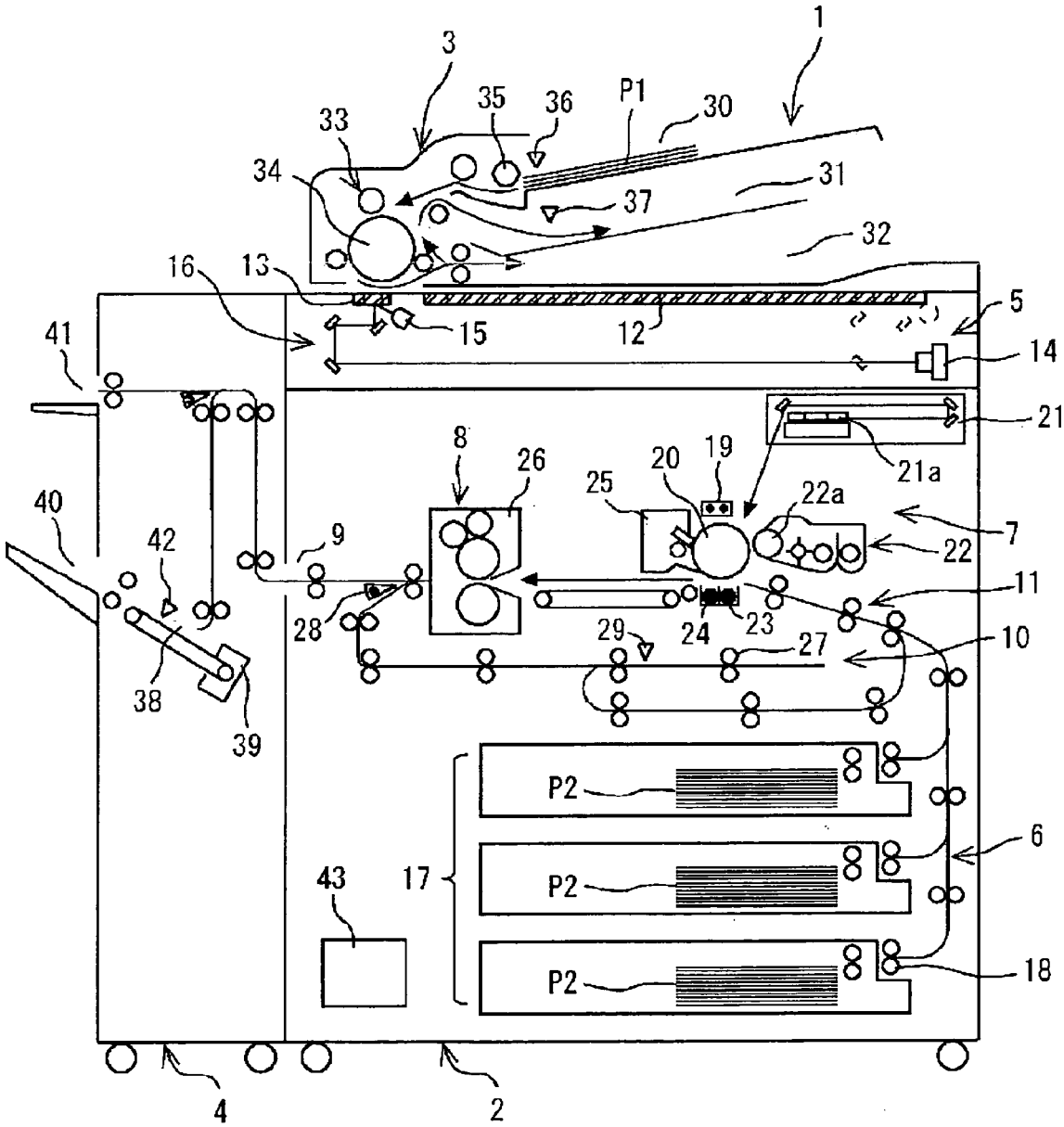
FIG. 1 is a schematic diagram of the internal structure of an image forming apparatus showing an embodiment of the present invention.

Some preferred embodiments of image forming apparatuses according to the present invention will now be described with reference to the accompanying drawings. FIG. 1 is a schematic sectional view showing the internal structure of an image forming apparatus according to an embodiment of the present invention. An image forming apparatus 1 of the embodiment determines operation modes executable upon setting an interrupt mode from the loading and transport states of originals P1 and paper P2, thus increasing the number of operation modes executable upon setting the interrupt mode.

The image forming apparatus 1 of the present invention includes an apparatus main body 2, an automatic document feeder 3, and a finisher 4.

The structure of the apparatus main body 2 will first be described. As shown in FIG. 1, the apparatus main body 2 includes a scanner section 5, a paper feeder section 6, a printer section 7, a fixing unit 8, a delivery section 9, a reversing unit 10, and a transport section 11. The scanner section 5 is an example of reading means, which is composed of a contact glass 12 on which an original is placed, a slit glass 13, an image sensor 14, a lamp 15, a mirror group 16 that leads reflected light of the lamp 15 to the image sensor 14.

The contact glass 12 is a rectangular plate glass of sufficient size to cover the size of any original P1 placed on it. The slit glass 13 is a strip of glass extending in the main scanning direction. The lamp 15 and the mirror group 16 are driven by a driving mechanism, not shown, to move in the sub-scanning direction. These elements provide illumination across the entire surface of the original P1 placed on the contact glass 12 so that the image sensor 14 can read the reflected light. Since the lamp 15 and the mirror group 16 are positioned underneath the slit glass 13, the original P1 fed by the automatic document feeder 3 in a manner described later can be illuminated so that the image sensor 14 will read the reflected light.

The paper feeder section 6 is composed of multiple paper feed cassettes 17 for holding paper P2 of different sizes, and transport mechanisms 18 such as rollers for pulling out and transporting paper P2 from each paper feed cassette 17. Thus the paper feeder section 6 supplies a predetermined size of paper P2 to the printer section 7. The printer section 7 is an example of printing means, which is composed of a corona charger 19, a photosensitive drum 20, an exposure unit 21, a developing unit 22, a transfer charger 23, a separation charger 24, a cleaning unit 25, etc.

The corona charger 19 charges the surface of the photosensitive drum 20 to a predetermined voltage prior to a latent-image formation process. The photosensitive drum 20 is made up of a cylindrical base member with its surface coated with a photosensitive layer, and driven to rotate by a driving mechanism, not shown. After making the photosensitive drum 20 uniformly charged by the corona charger 19 while rotating it, the exposure unit 21 performs exposures to form a latent image on the surface of the photosensitive drum 20.

In the exposure unit 21, a light beam projected from a laser, not shown, is reflected by a polygon mirror 21*a* and incident on the surface of the photosensitive drum 20. The polygon mirror 21*a* is rotating at a constant rotational speed, and the rotation of the polygon mirror 21*a* causes the laser beam to scan in the main scanning direction. On the other hand, the rotation of the photosensitive drum 20 causes the laser beam to scan in the sub-scanning direction. Thus the latent image is formed on the surface of the photosensitive drum 20. The electrostatic latent image formed on the photosensitive drum 20 is made visible by means of the developing unit 22.

The developing unit 22 includes a developing sleeve 22*a* and a mechanism for agitating toner in the developing unit 22 and supplying the toner. The toner supplied by the developing sleeve 22*a* to the photosensitive drum 20 is attracted to the latent image on the photosensitive drum 20 to form a toner image. The toner image on the photosensitive drum 20 is transferred from the photosensitive drum 20 to paper P2 by the transfer charger 23. Then the paper P2 with the toner image transferred on it is separated from the photosensitive drum 20 by the separation charger 24 and sent to the fixing unit 8. In other words, since the transfer charger 23 is arranged to face the photosensitive drum 20, it discharges from the back side of the paper P2 on the photosensitive drum 20 with the toner image electrostatically held on it, thus transferring the toner image onto the paper P2. The separation charger 24 neutralizes the charged surface of the paper P2 stuck to the photosensitive drum 20, and separates the paper P2 from the photosensitive drum 20.

The toner remaining on the photosensitive drum 20 without being transferred onto the paper P2 is collected by the cleaning unit 25. The cleaning unit 25 is equipped with a blade or the like that is arranged to contact the photosensitive drum 20 and scratch off and collect the toner adhering to the surface of the photosensitive drum 20. The fixing unit 8 is a fuser 26 for fixing the toner image. As mentioned above, the paper P2 on which the toner image has been transferred is sent to the fuser 26 in the printer section 7. The fuser 26 fixes the toner to the paper P2 through heat and pressure.

The delivery section 9 discharges the paper P2 processed by the fixing unit 8 to the outside. The reversing unit (ADU: Automatic Duplex Unit) 10 is an example of reversing means, which is composed of a reversing transport path 27 and the like. The paper P2 processed by the fixing unit 8 is sent to the reversing transport path 27 in which the paper P2 is turned upside down before it is sent to the printer section 7. The transport direction of the paper P2 that has passed through the fixing unit 8 can be changed by a transport switching gate 28 so that the paper P2 will be sent to either the delivery section 9 or the reversing unit 10 depending on the operation mode.

The transport section 11 is made up of a transport path and the like including the above-mentioned transport mechanisms 18 and the reversing transport path 27; it transports the paper P2. A sensor group for detecting the transport state of the paper P2 is provided in the transport section 11. Among the sensors, a paper detection sensor 29 for detecting the presence or absence of the paper P2 in the reversing transport path 27 is shown in FIG. 1. This paper detection sensor 29 is an example of paper detection means.

The structure of the automatic document feeder (ADF) 3 will next be described. The automatic document feeder 3 is an example of automatic document feeding means; it includes a document tray 30, a paper output tray 31, a reversing tray 32, and a paper feed mechanism 33. The paper feed mechanism 33 has a roller group such as a feed roller 34 arranged to face the slit glass 13, and a paper feed roller for pulling out originals P1 one by one from the document tray 30. A sensor group for detecting the transport state of the originals P1 is provided in the automatic document feeder 3. Among these sensors, a document detection sensor 36 for detecting the presence or absence of any original P1 on the document tray 30 and a document passing detection sensor 37 for detecting the completion of document feeding are shown in FIG. 1. The document detection sensor 36 and the document passing detection sensor 37 are examples of document detection means.

Next, the structure of the finisher 4 will be described. The finisher 4 is an example of post processing means, and is also called an after-treatment device. The finisher 4 shown in the embodiment is a stapler unit that includes a stacker 38, a binder 39, a main tray 40, a sub-tray 41, and a transport mechanism. The stacker 38 is an example of stacking means; it stacks sheets of paper P2 discharged one by one from the apparatus main body 2. The binder 39 is an example of binding means; it binds with a stapler multiple sheets of paper P2 stacked on the stacker 38. The sheets of paper P2 stacked on the stacker 38 and bound in the form of a book are discharged into the main tray 40. On the other hand, sheets of paper P2 to be discharged one by one from the apparatus main body 2 are discharged into the sub-tray 41 one by one as they are delivered.

A sensor group for detecting the transport state of the paper P2 is provided in the finisher 4. Among these sensors, a paper detection sensor 42 for detecting the presence or absence of the paper P2 on the stacker 38 is shown in FIG. 1. This paper detection sensor 42 is an example of paper detection means. Although not shown here, a mechanism for punching holes in the paper P2 can also be provided in the finisher 4.

The following describes the flows of originals P1 and paper P2 in the image forming apparatus 1.

The flow of original P1 in the automatic document feeder 3 will first be described. Multiple originals P1 set on the document tray 30 of the automatic document feeder 3 are pulled out one by one by means of the paper feed roller 35 of the paper feed mechanism 33, and transported over the slit glass 13. Each original P1 transported over the slit glass 13 is exposed to light from the lamp 15 so that reflected light from the original P1 will be read in by the image sensor 14. Since the original P1 is thus transported, the overall image of the original P1 can be read in.

When single-sided reading is set, the original P1 passing through the slit glass 13 is ejected into the output tray 31. When the double-sided reading is set, the original P1 is sent to the reversing tray 32, and to the feed roller 34 again. Thus the original P1 is turned upside down, and fed over the slit glass 13 again to achieve the double-sided reading of the original P1. The operation mode using the automatic document feeder 3 in the manner mentioned above is called the ADF mode.

The flow of paper 2 in the apparatus main body 2 and the finisher 4 will next be described. Sheets of paper P2 set in any paper feed cassette 17 are pulled out one by one by pull-out rollers as the transport mechanism 18, and sent to the printer section 7 through transport rollers in the transport section 11. After subjected to the printing process in the printer section 7, the paper P2 is sent to the fixing unit 8. Then, when single-sided printing is set, the paper P2 is sent from the delivery section 9 to the finisher 4. When double-sided printing is set, the paper P2 is sent from the fixing unit 8 to the reversing transport path 27, and to the printer section 7 again after being turned upside down through the reversing transport path 27. The operation mode for printing on both sides of the paper P2 using the reversing unit 10 in the manner mentioned above is called the ADU mode.

When the paper P2 sent to the finisher 4 is supposed to be outputted without after-treatment, it is ejected into the sub-tray 4. When stapling is set, a predetermined number of sheets of paper P2 are sent to the stacker 38. Then, when the predetermined number of sheets of paper P2 are stacked on the stacker 38, they are stapled together in the binder 39, and ejected into the main tray 40. The operation mode for stapling using the finisher 4 in the manner mentioned above is called the staple mode.

Next, the control system of the image forming apparatus 1 will be described. The operation of the image forming apparatus is controlled by a control unit 43 provided in the apparatus main body 2.

Figure 2:
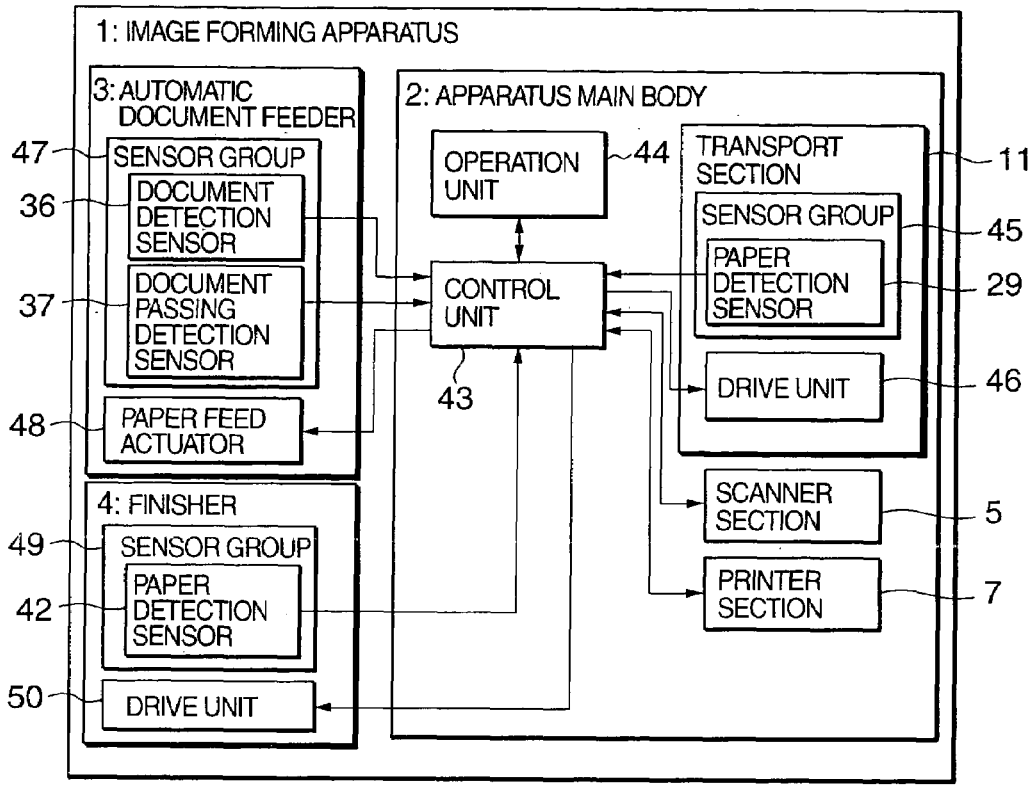
FIG. 2 is a block diagram showing an example of the structure of a control system in the image forming apparatus of the present invention.

FIG. 2 is a block diagram showing an example of the structure of the control system in the above-mentioned image forming apparatus as practiced in the embodiment of the present invention. The image forming apparatus 1 includes in the apparatus main body 2 the control unit 43 for controlling each component described in relation to FIG. 1, and an operation unit 44 through which the user performs operations. The transport section 11 in the apparatus main body 2 is provided with a sensor group 45 including the paper detection sensor 29, and a drive unit 46 for driving the transport rollers and the like.

The automatic document feeder 3 is provided with a sensor group 47 including the document detection sensor 36 and the document passing detection sensor 37, and a paper feed actuator 48 for actuating the paper feed mechanism 33. The finisher 4 is provided with a sensor group 49 including the paper detection sensor 42, and a drive unit 50 for a mechanism for stapling and transporting paper P2.

The control unit 43 is an example of control means; it controls the drive unit 46 of the apparatus main body 2, the scanner section 5, the printer section 7, the paper feed actuator 48 of the automatic document feeder 3, and the drive unit 50 of the finisher 4, according to the contents of operations designated by the user through the operation unit 44 and the outputs of the sensor group 45 of the apparatus main body 2, the sensor group 47 of the automatic document feeder 3, and the sensor group 49 of the finisher 4. The control unit 43 also causes the display of operation screens such as setting screens on the operation unit 44 in a manner described later.

The structure of the operation unit 44 will next be described.

Figure 3:
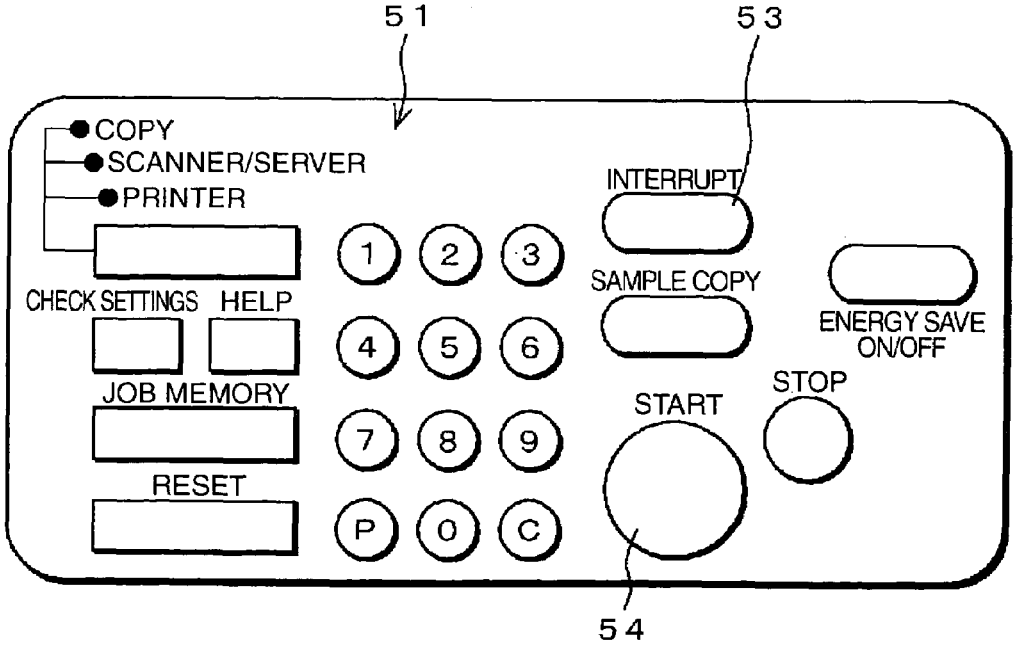
FIG. 3 is a plan view showing an example of the structure of a key input part on an operation unit.
Figure 4:
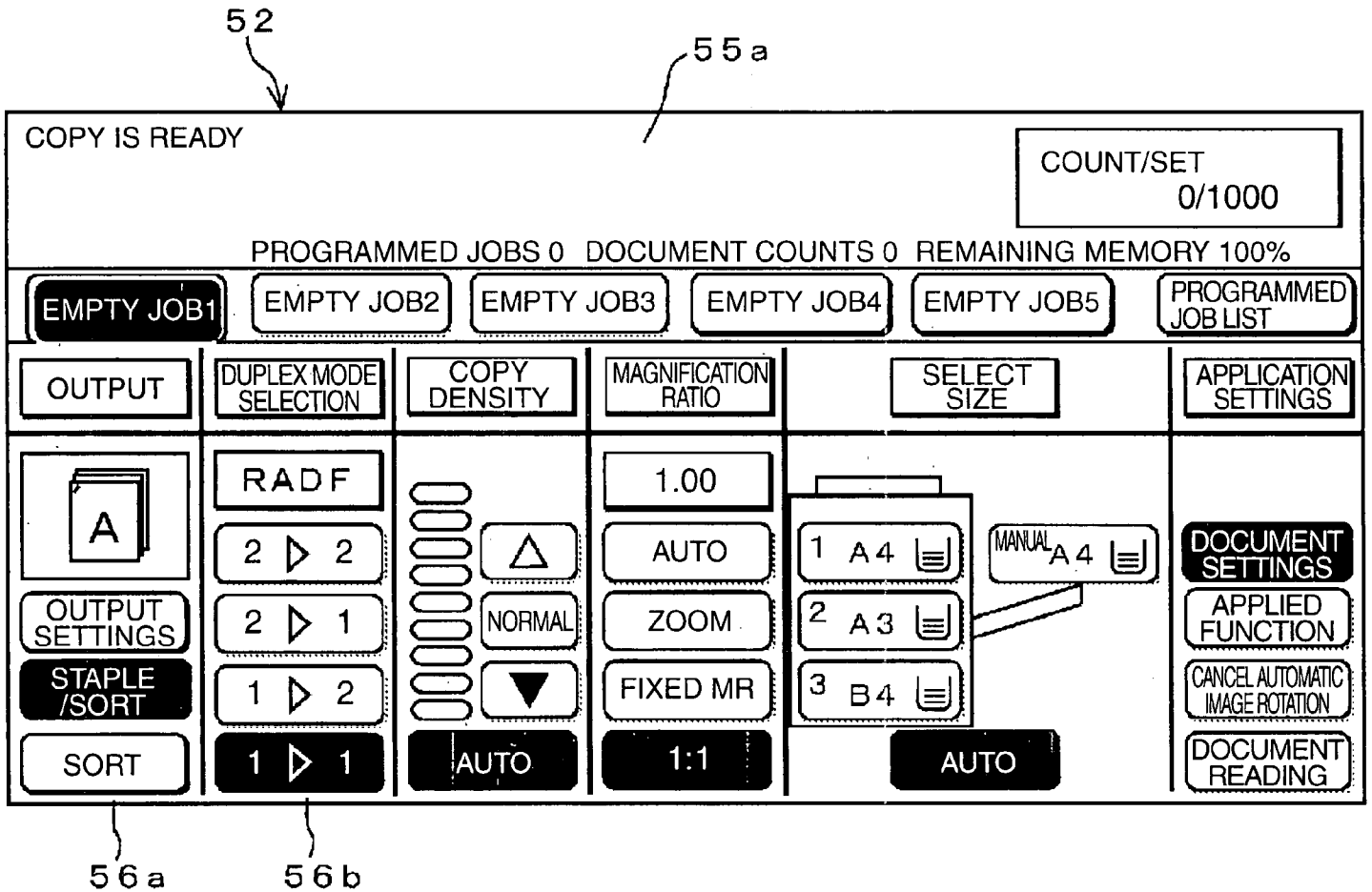
FIG. 4 is an illustration showing a display example of a display part on the operation unit.

FIG. 3 shows an example of the arrangement of a key input part 51 on the operation unit, and FIG. 4 is an illustration showing a display example of a display part 52 on the operation unit. The operation unit 44 is an example of operation means; it includes the key input part shown in FIG. 3 and the display part 52 shown in FIG. 4 arranged side by side on a front panel, not shown, of the apparatus main body 2. As shown in FIG. 3, the key input part 51 has an interrupt button 53 for instructing an interrupt operation and a start button 54 for starting various kinds of operations. In addition to these buttons, the key input part 51 also has various other buttons, such as a button to switch among the functions of the image forming apparatus of multifunctional type, a numerical ten keypad to enter the number of copies and the like.

The display part 52 is, for example, a liquid crystal display with a touch panel on which a setting screen **55*a* is displayed as shown in FIG. 4. The setting screen 55*a* includes an output form selection part 56*a* and a duplex mode selection part 56*b*, in each of which various buttons are displayed. The output form selection part 56*a* gives a choice of output forms of paper P2 so that the user can select one of the output forms. The duplex mode selection part 56*a* gives a choice of options, such as an option to read an image from one side of original P1 and print it on one side of paper P2, and an option to read images from both sides of original P1 and print them on both sides of paper P2. In the output form selection part 56*a*, buttons to switch between the presence and absence of the staple mode are displayed. In the duplex mode selection part 56*b*, buttons to switch among reading and printing options to determine whether to select an operation mode for double-sided reading and double-sided printing so as to set the ADF mode and ADU mode are displayed. The setting screen 55*a*** further includes a copy density selection part, a magnification ratio selection part, a paper size selection part, etc.

The image forming apparatus 1 enables the user to select an operation mode in the following way. The user touches a desired button on the setting screen **55*a* displayed on the display part 52 while viewing each of the selection parts, and then presses the start button 54 on the key input part 51. For example, the user may select such a copying operation as to staple and output sheets of paper P2. In FIG. 4**, selected buttons are displayed in reverse video, changing from black-on-white to white-on-black.

Next, the structure for processing image data in the image forming apparatus 1 will be described.

Figure 5:
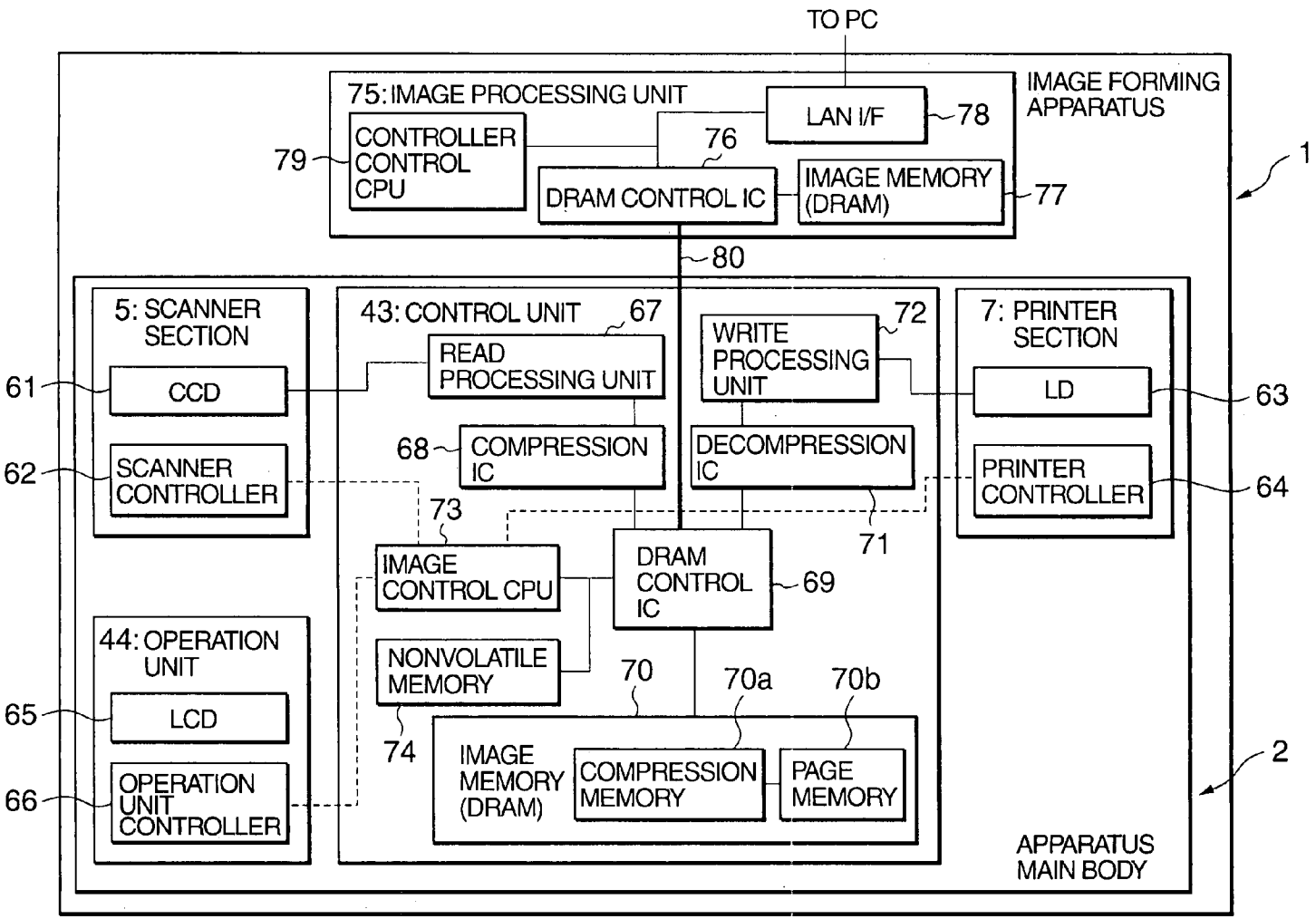
FIG. 5 is a block diagram showing an example of the detailed structure of the control system of the image forming apparatus.

FIG. 5 is a block diagram showing an example of the detailed structure of the control system in the image forming apparatus 1. As shown, the scanner section 5 includes a CCD (Charge Coupled Device) 61 constituting the image sensor 14 shown in FIG. 1 and a scanner controller 62. The printer section 7 includes a laser diode (LD) 63 provided in the exposure unit 21 shown in FIG. 1, and a printer controller 64. The operation unit 44 includes a liquid crystal display (LCD) 65 shown in FIG. 4 and an operation unit controller 66.

The control unit 43 described in relation to FIG. 2 has the following image forming structure: a read processing unit 67, a compression IC (Integrated Circuit) 68, a DRAM (Dynamic Random Access Memory) control IC 69, an image memory 70, a decompression IC 71, a write processing unit 72, an image control CPU (Central Processing Unit) 73, and a nonvolatile memory 74.

The read processing unit 67 performs processing such as analog-to-digital conversion of image data outputted from the CCD 61. The compression IC 67 compresses the image data in a predetermined format. The DRAM control IC 69 performs the writing and reading of the image data to and from the image memory 70. The image memory 70 is a DRAM including a compression memory 70*a* for storing compressed image data and a page memory 70*b* for storing image data in certain units. The decompression IC 71 decompresses the compressed image data. The write processing unit 72 performs processing such as digital-to-analog conversion of the image data, and outputs the processed image data to the laser diode 63. The image control CPU 73 controls the scanner controller 62 and the printer controller 64 to acquire and print image data, while it controls the operation unit controller 66 to display a proper screen on the liquid crystal display 65. The nonvolatile memory 74 stores programs such as one executed by the image control CPU.

To interface to external devices, the image forming apparatus 1 includes an image processing unit (print/scanner controller) 75. The image processing unit 75 has a DRAM control IC 76, an image memory 77, a LAN (Local Area Network) I/F 78, and a controller control CPU 79. The DRAM control IC 76 performs the writing and reading of image data to and from the image memory 77. The image memory 77 is a DRAM. The DRAM control IC 76 in the image processing unit 75 and the DRAM control IC 69 in the apparatus main body 2 are interconnected through a PCI (Peripheral Component Interconnect) bus 80. The LAN I/F 78 connects the image forming apparatus 1 to a network, not shown. The controller control CPU 79 enables the image forming apparatus 1 to exchange image data with a personal computer(s), not shown, connected to the network.

The flow of image data will next be described using FIG. 5. When image data is read from an original P1 using the image forming apparatus 1 as a copying machine or scanner, the image data is read in by the CCD 61, processed in the read processing unit 67, compressed in the compression IC 68, and stored in the compression memory 70*a* of the image memory 70 under the control of the DRAM control IC 69.

When electronic image data is read from a terminal such as a personal computer using the image forming apparatus 1 as a printer, the image data is first stored in the image memory 77 of the image processing unit 75. Then the image data stored in the image memory 77 is read out by the DRAM control IC 76 of the image processing unit 75, sent to the apparatus main body 2 though the PCI bus 80, and stored in the page memory 70*b* of the image memory 70 under the control of the DRAM control IC 69. The image data stored in the page memory 70*b* is read out by the DRAM control IC 69, compressed by the compression IC 68, and stored in the compression memory 70*a* of the image memory 70 under the control of the DRAM control IC 69.

When image data is printed on paper P2 using the image forming apparatus 1 as a copying machine or printer, the image data stored in the compression memory 70*a* of the image memory 70 is read by the DRAM control IC 69, decompressed by the decompression IC 71, sent to the laser diode 63 by means of the write processing unit 72, and printed on the paper P2 through the mechanism described in relation to FIG. 1.

When image data is externally outputted using the image forming apparatus 1 as a scanner, the image data stored in the compression memory 70*a* of the image memory 70 is read out by the DRAM control IC 69, decompressed by the decompression IC 71, and stored in the page memory 70*b* of the image memory 70 under the control of the DRAM control IC 69. Then the image data stored in the page memory 70*b* is read out by the DRAM control IC 69, sent to the image processing unit 75 through the PCI bus 80, and stored in the image memory 77 under the control of the DRAM control IC 76. The image data stored in the image memory 77 is transmitted by the LAN I/F 78 to a terminal through a network, not shown.

Next, the operation of the image forming apparatus shown in the above embodiment of the present invention will be described.

The image forming apparatus 1 of the present invention is enabled to select either of two operation modes, namely either an "interrupt mode to interrupt operation after completion of a required number of copies" as shown in the following first to third operation examples or an "interrupt mode to interrupt operation halfway through making the required number of copies (also called an instant stop mode)" as shown in the fourth operation example. These operation modes are preset as initial settings, and when the execution of the interrupt mode is requested, an operation is performed according to the initial setting.

Figure 6:
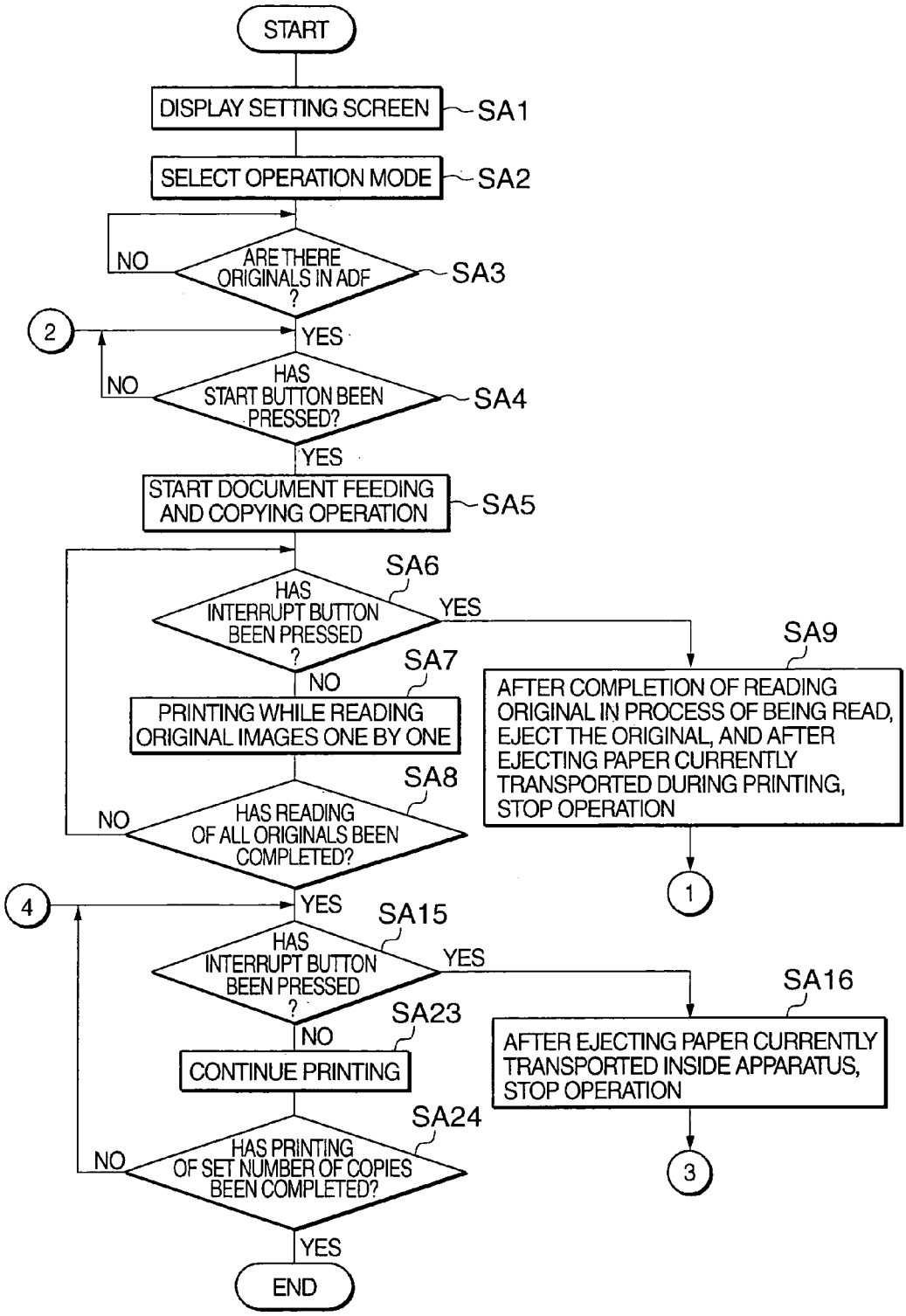
FIG. 6 is a flowchart showing a first operation example in the image forming apparatus of the present invention.
Figure 7:
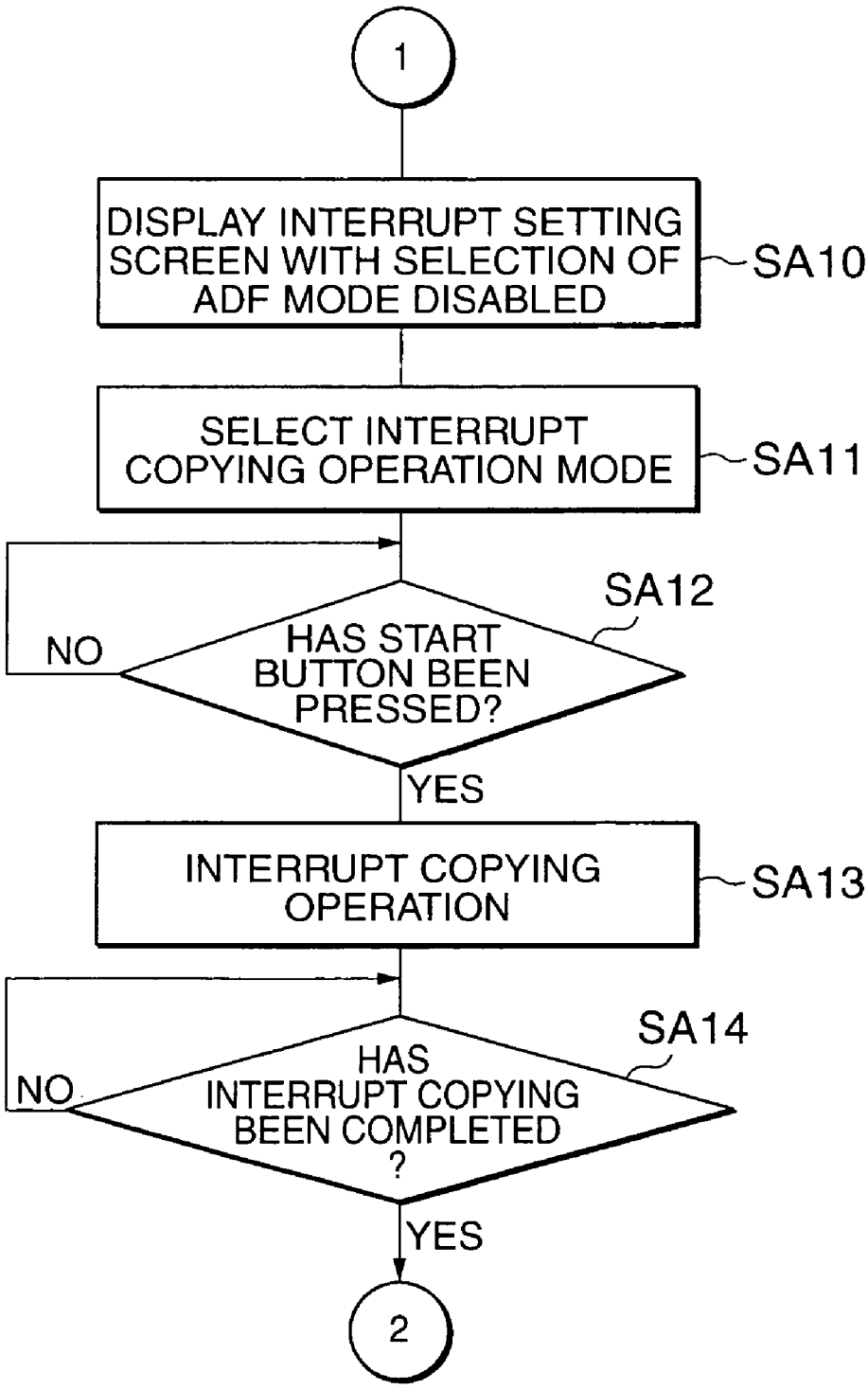
FIG. 7 is a flowchart continued from FIG. 6, showing the example of the first operation in the image forming apparatus of the present invention.
Figure 8:
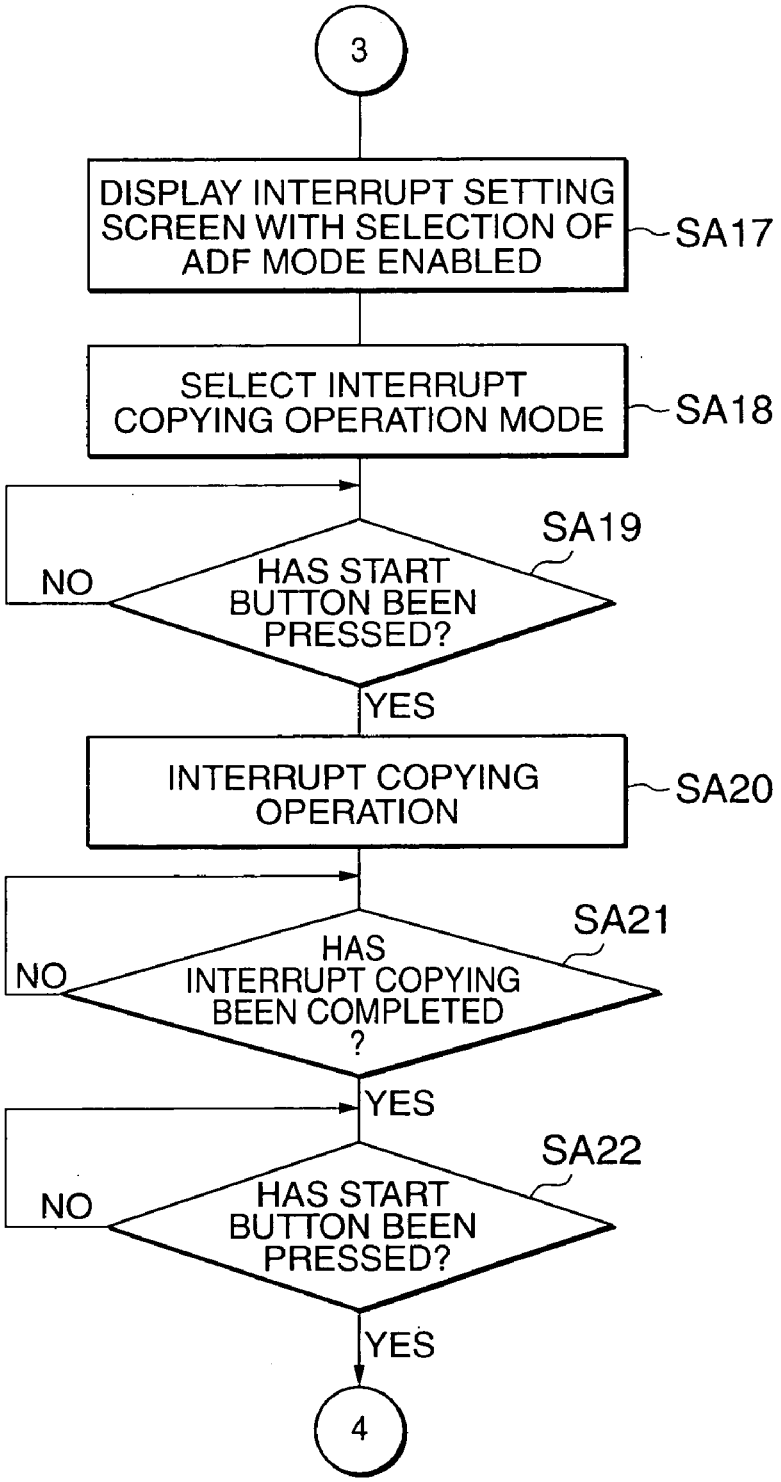
FIG. 8 is a flowchart continued from FIG. 6, showing the example of the first operation in the image forming apparatus of the present invention.

FIGS. 6 to 8 are flowcharts showing the first operation example of the image forming apparatus 1 of the present invention. The following description of the operation also refers to FIGS. 1 to 4 as appropriate.

First, the control unit 43 causes the display of the setting screen 55*a,* shown in FIG. 4, on the display part 52 of the operation unit 44 (step SA1). The user sees this setting screen 55*a* and selects a desired operation mode (step SA2). In the first operation example, suppose that the user has selected such an operation mode as to read image data from one side of each of originals P1, print the image data on one side of each sheet of paper P2, and output the sheets of paper P2 without being stapled.

When the user sets originals P1 on the document tray 30 of the automatic document feeder 3, the document detection sensor 36 detects "the presence of originals (step SA3). When detecting "the press of the start button 54" on the operation unit 44 shown in FIG. 3 (step SA4), the control unit 43 starts copying operation according to the operation mode selected by the user (step SA5). Then, when the interrupt button 53 shown in FIG. 3 is pressed, the precedent copying operation becomes an interrupted job. Therefore, the control unit 43 keeps track of whether the interrupt button 53 is pressed or not (step SA6). When not detecting "the press of the interrupt button 53" at step SA6, the control unit 43 controls the paper feed actuator 48 shown in FIG. 2 to feed the originals P1 one by one, controls the scanner section 5 to read image data from each original P1, and controls the printer section 7 to print (or copy) the image data on each sheet of paper P2 (step SA7).

The control unit 43 detects the presence or absence of originals from the outputs of the document detection sensor 36 and the document passing detection sensor 37 to determine whether the reading of all the originals P1 set on the document tray 30 has been completed (step SA8). In other words, when the document detection sensor 36 detects "no originals" and the document passing detection sensor 37 detects that "the rear end of the last original P1 has passed," the control unit 43 determines that the reading of all the originals P1 has been completed.

On the other hand, when determining at step SA8 that the reading of all the originals P1 has not been completed yet, the control unit 43 returns to step SA6 to keep track of, the presence or absence of the press of the interrupt button 53 while continuing the paper feeding and copying operations.

Then, when determining at step SA6 that "the interrupt button 53 has been pressed," the control unit 43 determines, from the output of the document passing detection sensor 37, the presence or absence of any original P1 that is in the process of being read. When the control unit 43 determines that "there is an original P1 in the process of being read," the transportation and reading of the original P1 in process are continued. Then, when the document passing detection sensor 37 detects that the rear end of the original P1 has passed, further feeding is inhibited.

The control unit 43 can also determine, from the output of the sensor group 45 and the like, the presence or absence of paper P2 in the process of printing on it. Then, after a sheet of paper P2 is pulled out from one of the paper feed cassettes 17, when the control unit 43 determines that "there is paper P2 in the process of printing on it" in the transport path, the transportation of and printing on the paper P2 are continued. Finally, the paper P2 on which printing has been done is ejected into the sub-tray 41 shown in FIG. 1 and further printing is inhibited (step SA9).

Next, the control unit 43 causes the display of a predetermined interrupt copy setting screen on the display part 52 of the operation unit 44 according to the outputs of the sensors to urge the user to do various settings such as to set an output form in the interrupt mode (step SA10).

Figure 9:
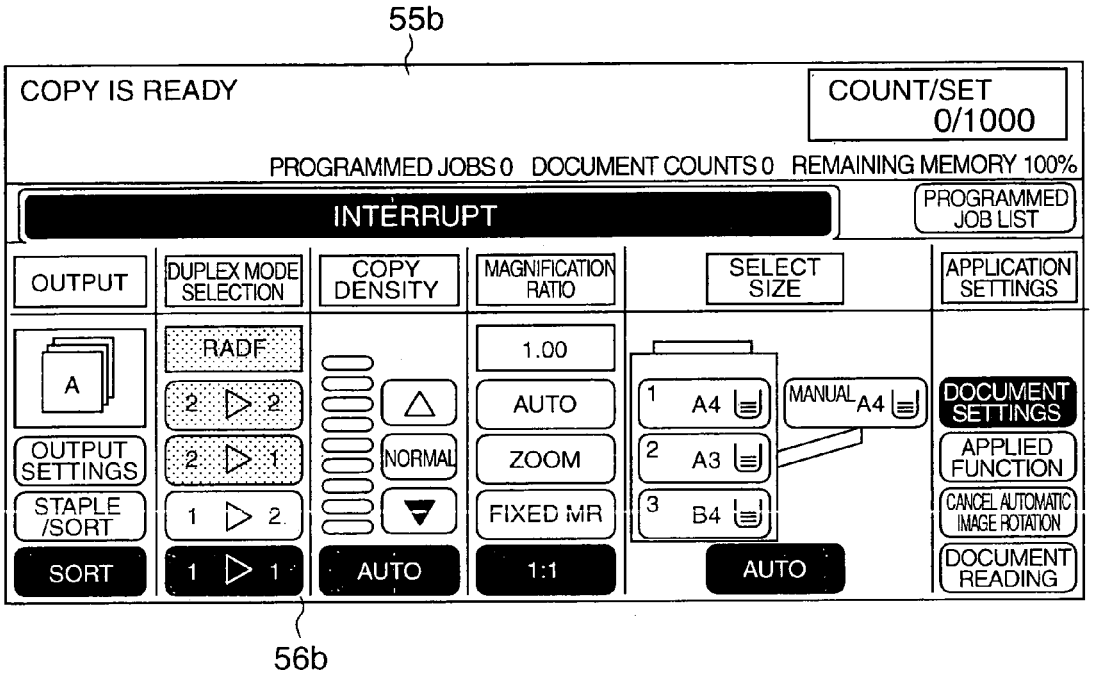
FIG. 9 is an illustration showing an example of the display of an interrupt copy setting screen that disables the selection of ADF mode.

FIG. 9 is an illustration showing an example of the interrupt copying setting screen. When "the press of the interrupt button 53" is detected at step SA6, since it means that the reading operation was halted with one or more unread originals P1 remaining on the document tray 30 of the automatic document feeder 3, the document detection sensor 36 detects "the presence of one or more originals." Therefore, the control unit 43 causes an interrupt copy setting screen 55*b* with "the selection of the ADF (RADF) mode disabled" as an operation mode using the automatic document feeder 3, and displays it on the display part 52 of the operation unit 44. In other words, the buttons to select the double-sided reading operations in the duplex mode selection part 56*b* on the interrupt copy setting screen 55*b* are shown with half-tone dot meshing to indicate that the selection of these operations is disabled.

The user sees the interrupt copy setting screen 55*b* (see FIG. 9) displayed on the display part 52 and selects an operation mode in the interrupt mode (step SA11). Then, the user places an original P1 on the contact glass 12 and presses the start button 54 (step SA12). When detecting "the press of the start button 54" at step SA12, the control unit 43 starts the interrupt copying operation according to the operation mode selected by the user at step SA11 (step SA13). In this copying operation, even if detecting that "there is one or more originals" on the document tray 30 from the output of the document detection sensor 36 of the automatic document feeder 3, the control unit 43 inhibits the automatic document feeder 3 from performing the document feeding operation. Instead, the control unit 43 controls the scanner section 5 to read an image of the original P1 on the contact glass 12 and the printer section 7 to perform printing. After completion of the interrupt copying operation (step SA14), the control unit 43 returns to step SA4. Then, when detecting "the press of the start button 54," the control unit 43 resumes the interrupted job.

After that, when determining the completion of reading image data of all the originals P1 at step SA8, the control unit 43 continuously monitors the presence or absence of the press of the interrupt button 53 during printing operation (step SA15). Then, when detecting "the press of the interrupt button 53," the control unit 43 determines, from the output of the sensor group 45 and the like, the presence or absence of paper P2 in the process of printing on it. When determining that "there is a sheet of paper P2 in the process of printing on it" after pulled out from one of the paper feed cassettes 17, the control unit 43 continues the transportation of and printing on the paper P2 in process. Then, after the paper P2 on which printing has been done is ejected into the sub-tray 41, the control unit 43 inhibits further printing (step SA16).

After that, the control unit 43 causes the display of a predetermined interrupt copy setting screen on the display part 52 of the operation unit 44 according to the outputs of the sensors (step SA17).

Figure 10:
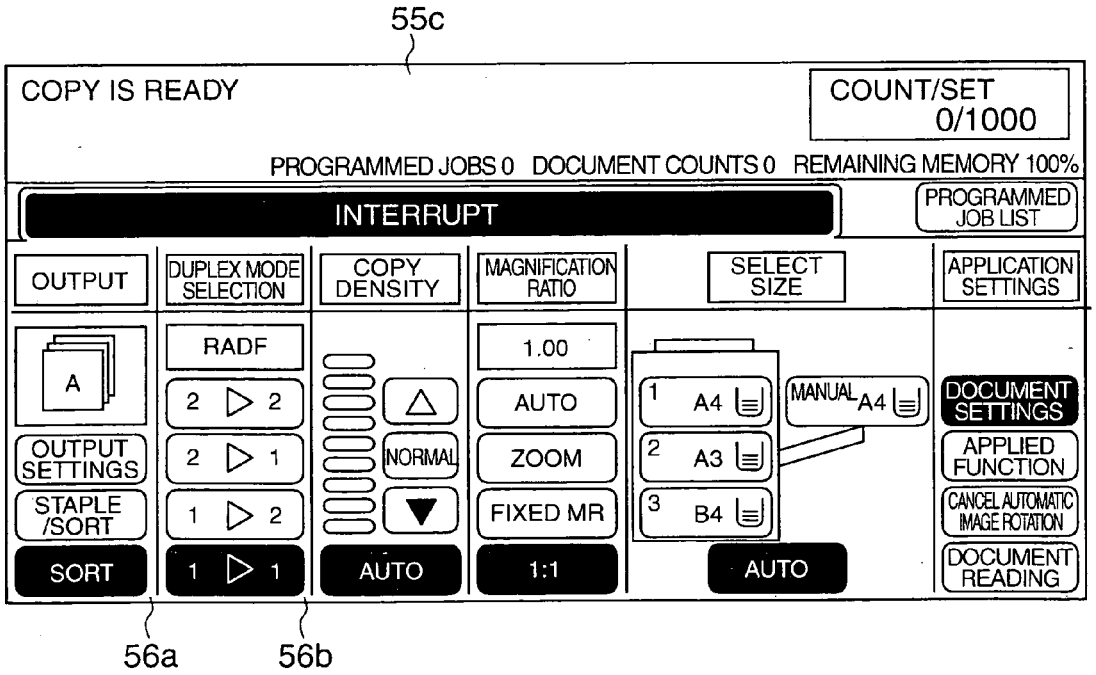
FIG. 10 is an illustration showing an example of the display of an interrupt copy setting screen that enables the selection of all operation modes.

FIG. 10 is an illustration showing another example of the interrupt copy setting screen. When "the press of the interrupt button 53" is detected ate step SA15, since it means that no originals P1 remain on the document tray 30 of the automatic document feeder 3, the document detection sensor 36 detects "the absence of originals." Therefore, the control unit 43 causes an interrupt copy setting screen 55*c* with the selection of the ADF mode enabled, and displays it on the display part 52. In other words, the buttons to select the double-sided reading of originals P1 in the duplex mode selection part 56*b* on the interrupt copy setting screen 55*c* are activated and become selectable.

The user sees the interrupt copy setting screen 55*c* (see FIG. 10) displayed on the display part 52 and selects an operation mode in the interrupt mode (step SA18). Then, the user presses the start button 54 (step SA19). When detecting "the press of the start button 54" at step SA19, the control unit 43 starts the interrupt copying operation according to the operation mode selected by the user at step SA18 (step SA20). In this copying operation, if an original P1 is placed on the contact glass 12, the control unit 43 controls the scanner section 5 to read an image of the original P1 on the contact glass 12 and the printer section 7 to perform printing. Further, when detecting "the presence of one or more originals" on the document tray 30 from the output of the document detection sensor 36 of the automatic document feeder 3, the control unit 43 controls the automatic document feeder 3 to perform the document feeding operation, while controlling the scanner section 5 to read images one by one from the originals and the printer section 7 to perform printing. After completion of the interrupt copying operation (step SA21), the control unit 43 resumes monitoring the presence or absence of the press of the start button 54 (step SA22). Then, when detecting "the press of the start button 54" at step SA22, the control unit 43 returns to step SA15.

When not detecting "the press of the interrupt button 53" at step SA15, the control unit 43 continues the printing operation of the interrupted job (step SA23). Then, after the completion of printing of a set number of copies (step SA24), the copying operation for the interrupted job is completed.

Figure 11:
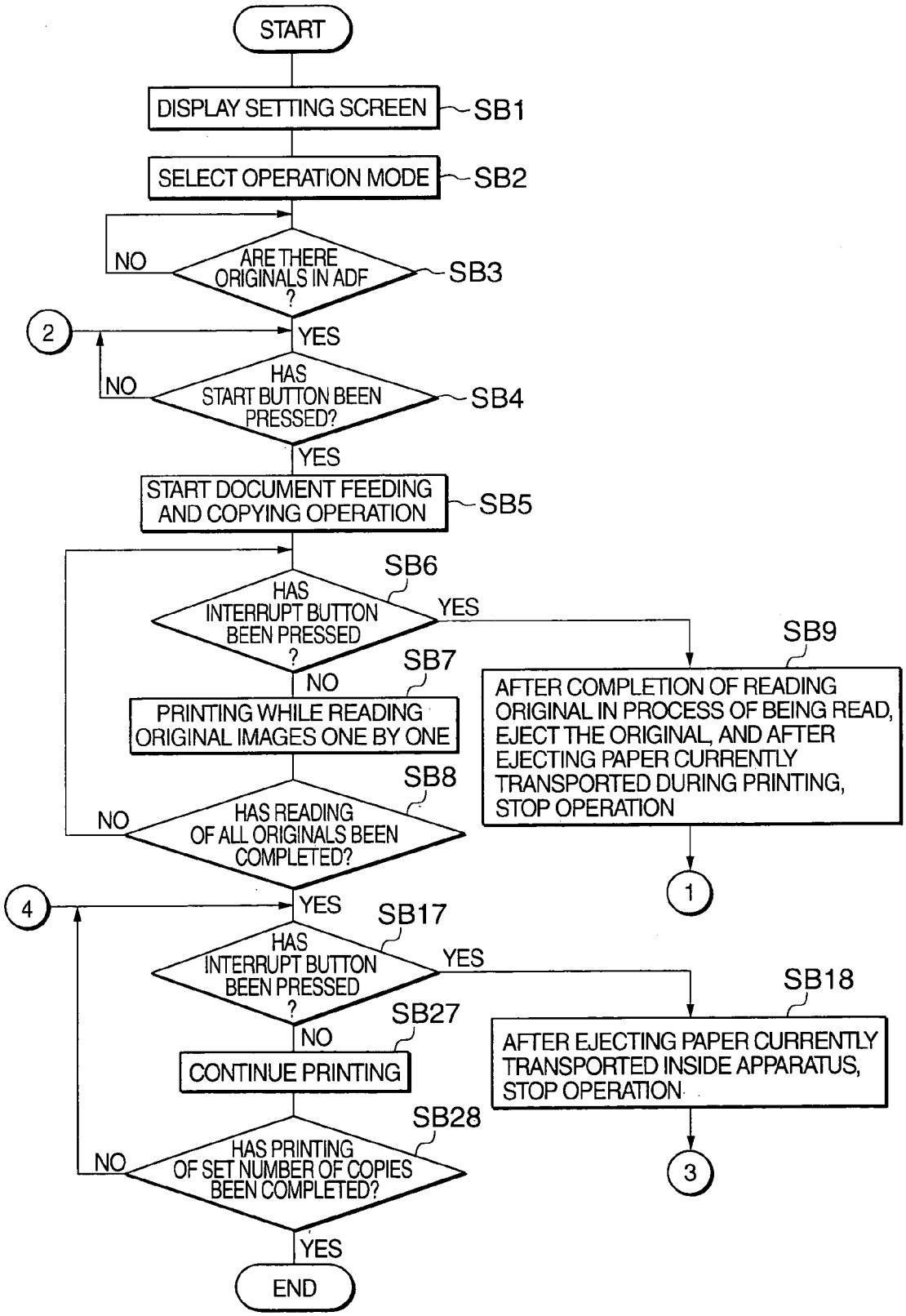
FIG. 11 is a flowchart showing a second operation example in the image forming apparatus of the present invention.
Figure 12:
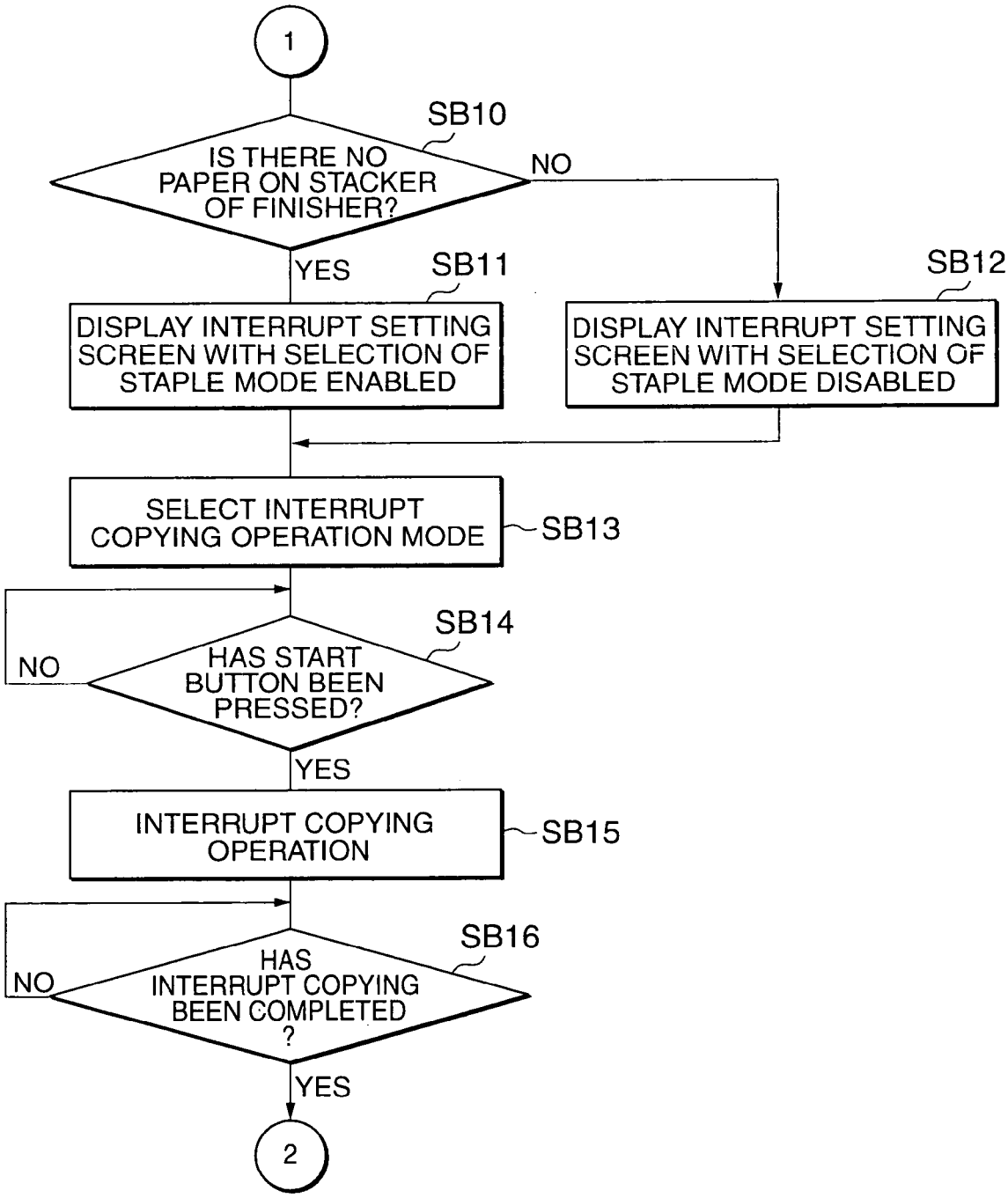
FIG. 12 is a flowchart continued from FIG. 11, showing the example of the second operation in the image forming apparatus of the present invention.
Figure 13:
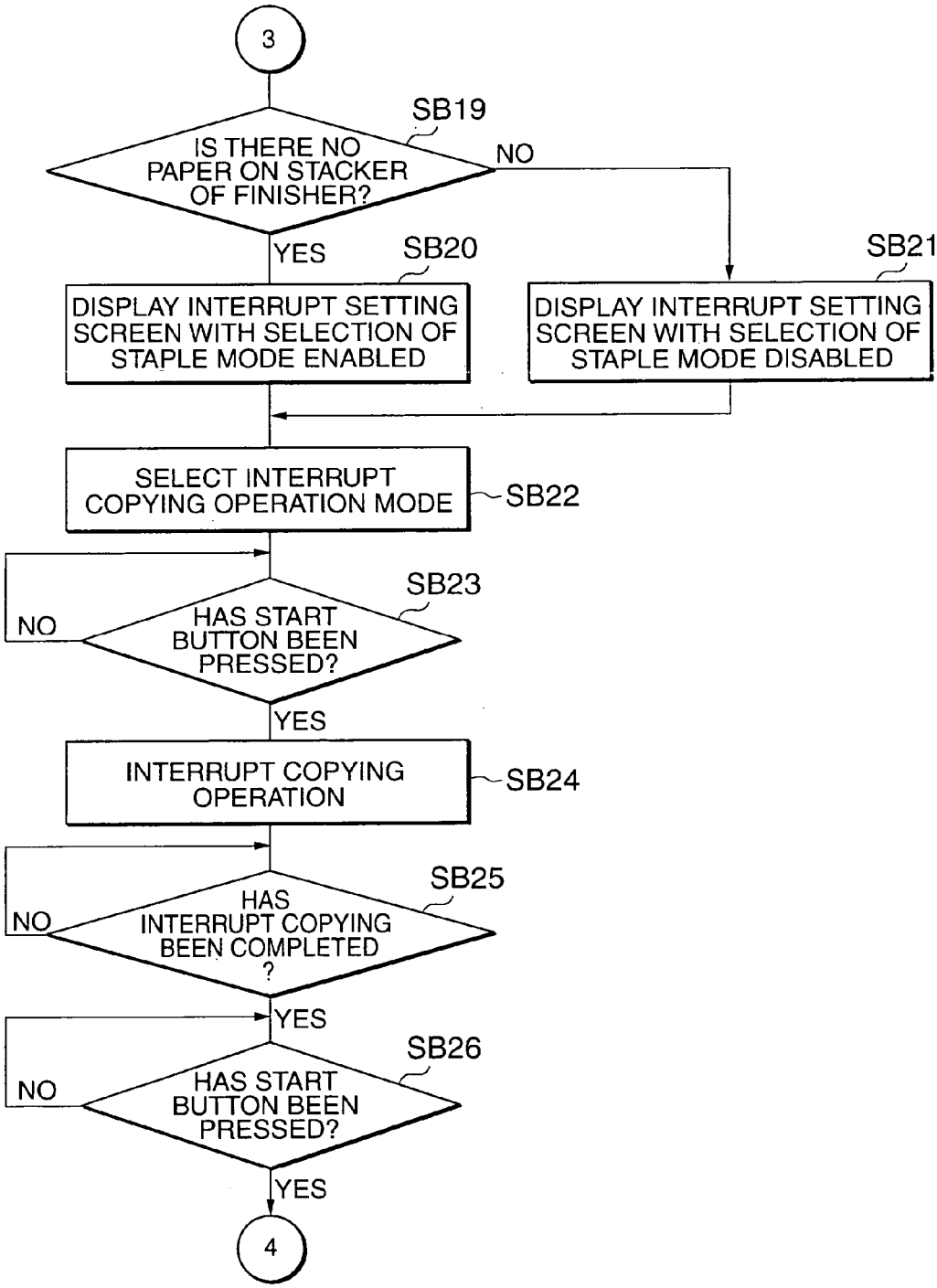
FIG. 13 is a flowchart continued from FIG. 11, showing the example of the second operation in the image forming apparatus of the present invention.

FIGS. 11 to 13 are flowcharts showing the second operation example of the image forming apparatus 1 of the present invention. The following description of the operation also refers to FIGS. 1 to 4 as appropriate.

First, the control unit 43 causes the display of the setting screen 55*a* (see FIG. 4) on the display part 52 of the operation unit 44 (step SB1). The user sees this setting screen 55*a* and selects a desired operation mode (step SB2). In the second operation example, suppose that the user has selected such an operation mode as to read image data from one side of each of originals P1, print the image data on one side of each sheet of paper P2, and staple and output the sheets of paper P2.

When the user sets originals P1 on the document tray 30 of the automatic document feeder 3, the document detection sensor 36 detects "the presence of originals (step SB3). When detecting "the press of the start button 54" on the operation unit 44 shown in FIG. 3 (step SB4) the control unit 43 starts copying operation according to the operation mode selected by the user (step SB5). The control unit 43 also monitors the presence or absence of the press of the interrupt button 53 on the operation unit 44 (step SB6). When not detecting "the press of the interrupt button 53" at step SB6, the control unit 43 controls the paper feed actuator 48 to feed the originals P1 one by one, controls the scanner section 5 to read image data from each original P1, and controls the printer section 7 to print (or copy) the image data on each sheet of paper P2. Further, the control unit 43 controls the drive unit 50 to stack a predetermined number of sheets of paper P2 on the stacker 38, staple the sheets together by means of the binder 39, and eject them into the main tray 40 (step SB7).

The control unit 43 detects the presence or absence of originals from the outputs of the document detection sensor 36 and the document passing detection sensor 37 to determine whether the reading of all the originals P1 set on the document tray 30 has been completed (step SB8). In other words, when the document detection sensor 36 detects "no originals" and the document passing detection sensor 37 detects that "the rear end of the last original P1 has passed," the control unit 43 determines that the reading of all the originals P1 has been completed.

On the other hand, when determining at step SB8 that the reading of all the originals P1 has not been completed yet, the control unit 43 returns to step SB6 to keep track of the presence or absence of the press of the interrupt button 53 while continuing the paper feeding and copying operations.

Then, when determining at step SB6 that "the interrupt button 53 has been pressed," the control unit 43 determines, from the output of the document passing detection sensor 37, the presence or absence of any original P1 in the process of being read. When the control unit 43 determines that "there is an original P1 in the process of being read," the transportation and reading of the original P1 in process are continued. Then, when the document passing detection sensor 37 detects that the rear end of the original P1 has passed, further feeding is inhibited.

The control unit 43 can also determine, from the output of the sensor group 45 and the like, the presence or absence of paper P2 in the process of printing on it. Then, after a sheet of paper P2 is pulled out from one of the paper feed cassettes 17, when the control unit 43 determines that "there is paper P2 in the process of printing on it" in the transport path, the transportation of and printing on the paper P2 are continued. Finally, the paper P2 on which printing has been done is ejected into the stacker 38 and further printing is inhibited (step SB9).

Next, the control unit 43 determines the presence or absence of paper P2 on the stacker 38 from the detection result of the paper detection sensor 42 (step SB10). When determining "no paper P2 on the stacker 38" at step SB10, the control unit 43 causes the display of the interrupt copy setting screen 55*b* shown in FIG. 9 on the display part 32 (step SB11).

In other words, since the control unit 43 has determined at step SB10 "no paper on the stacker 38," the paper P2 can be stacked on the stacker 38 without being mixed up with paper P2 for the interrupted job. Therefore, the control unit 43 causes the interrupt copy setting screen 55*b* with the selection of the staple mode enabled, as an operation mode using the stacker 38, and displays it on the display part 52. When "the press of the interrupt button 53" is detected at step SB6, since it means that the reading operation was halted with one or more unread originals P1 remaining on the document tray 30 of the automatic document feeder 3, the document detection sensor 36 detects "the presence of one or more originals." Thus the selection of the ADF mode using the automatic document feeder 3 is disabled. In other words, the buttons to select the double-sided reading of originals P1 in the duplex mode selection part 56*b* on the interrupt copy setting screen 55*b* are shown with half-tone dot meshing to indicate that the selection of these operations is disabled.

When determining "the presence of paper P2 on the stacker 38" at step SB10, the control unit 43 causes an interrupt copy setting screen with the selection of the staple mode disabled, and displays it on the display part 52 (step SB12).

Figure 14:
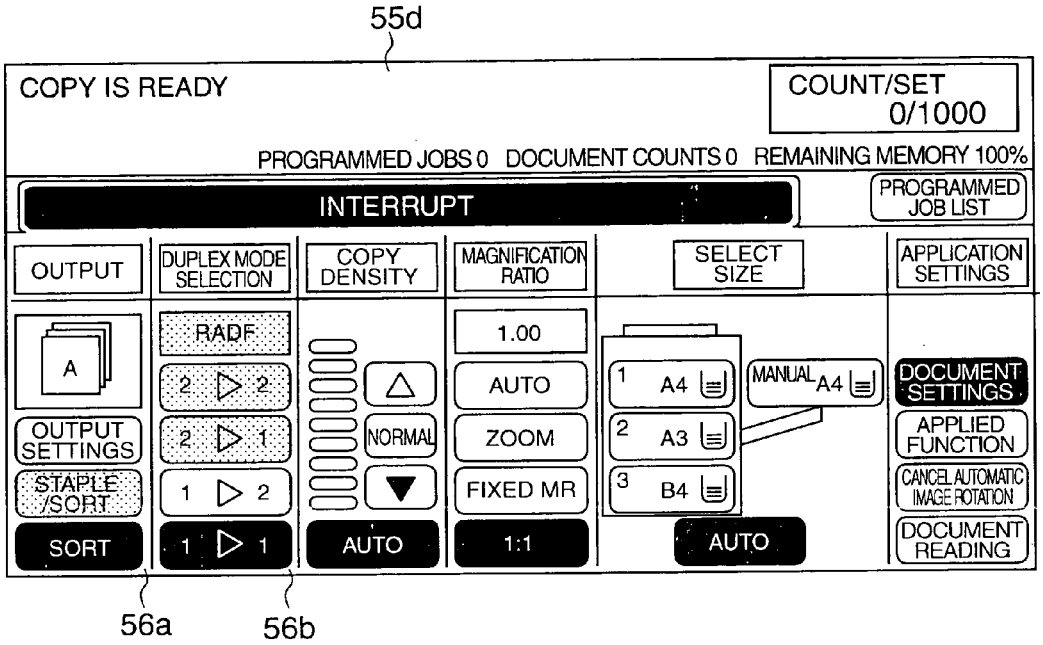
FIG. 14 is an illustration showing an example of the display of an interrupt copy setting screen that disables the selection of staple and ADF modes.

FIG. 14 is an illustration showing a display example of the interrupt copy setting screen. Since the control unit 43 has determined "the presence of paper on the stacker 38" at step SB10, if paper P2 for the interrupt job is sent to the stacker 38, it will be mixed up with those of paper P2 for the interrupted job. Therefore, the control unit 43 causes an interrupt copy setting screen 55*d* with the selection of the staple mode using the stacker 38 disabled, and displays it on the display part 52. In other words, the button to select the binding operation in the output form selection part 56*a* on the interrupt copy setting screen 55*d* is shown with half-tone dot meshing to indicate that the selection of this operation is disabled. The reason why the selection of the ADF mode is disabled in the duplex mode selection part 56*b* on the interrupt copy setting screen 55*d* displayed in response to the processing step SB12 is that, as mentioned above, the reading operation was halted with one or more unread originals P1 remaining on the document tray 30 of the automatic document feeder 3.

The user sees the interrupt copy setting screen 55*d* displayed on the display part 52 according to the detection results of the paper detection sensor 42 and the like, such as the presence or absence of paper P2, and selects an operation mode in the interrupt mode (step SB13). Then, the user places an original P1 on the contact glass 12 and presses the start button 54 (step SB14). When detecting "the press of the start button 54" at step SB14, the control unit 43 starts the interrupt copying operation according to the operation mode selected by the user at step SB13 (step SB15). In this copying operation, even if detecting that "there is one or more originals" on the document tray 30 from the output of the document detection sensor 36 of the automatic document feeder 3, the control unit 43 inhibits the automatic document feeder 3 from performing the document feeding operation. Instead, the control unit 43 controls the scanner section 5 to read an image of the original P1 on the contact glass 12 and the printer section 7 to perform printing. After completion of the interrupt copying operation (step SB16), the control unit 43 returns to step SB4, and when detecting "the press of the start button 54" at step SB4, it resumes the interrupted job.

When determining the completion of reading image data of all the originals P1 at step SB8, the control unit 43 continuously monitors the presence or absence of the press of the interrupt button 53 during printing operation (step SB17). Then, when detecting "the press of the interrupt button 53" at step SB17, the control unit 43 determines, from the output of the sensor group 45 and the like, the presence or absence of paper P2 in the process of printing on it. When it is determined that "there is a sheet of paper P2 in the process of printing on it" after pulled out from one of the paper feed cassettes 17, the transportation of and printing on the paper P2 in process are continued. Then, after the paper P2 on which printing has been done is ejected into the stacker 38, further printing is inhibited (step SB18).

Next, the control unit 43 determines the presence or absence of paper P2 on the stacker 38 from the detection result of the paper detection sensor 42 (step SB19). When determining that "there is no paper P2 on the stacker 38" at step SB19, the control unit 43 causes the interrupt copy setting screen 55*c* shown in FIG. 10, and displays it on the display part 52 (step SB20).

In other words, since the control unit 43 has determined at step SB19 "no paper on the stacker 38," the paper P2 can be stacked on the stacker 38 without being mixed up with paper P2 for the interrupted job. Therefore, the control unit 43 causes the interrupt copy setting screen 55*c* with the selection of the staple mode using the stacker 38 of the finisher 4 enabled, and displays it on the display part 52. When "the press of the interrupt button 53" is detected at step SB17, since it means that no originals P1 remain on the document tray 30 of the automatic document feeder 3, the document detection sensor 36 detects "the absence of originals." Thus the selection of the ADF mode is enabled. In other words, all the buttons in the output form selection part 56*a* and the duplex mode selection part 56*b* on the interrupt copy setting screen 55*c* are activated and become selectable.

Figure 15:
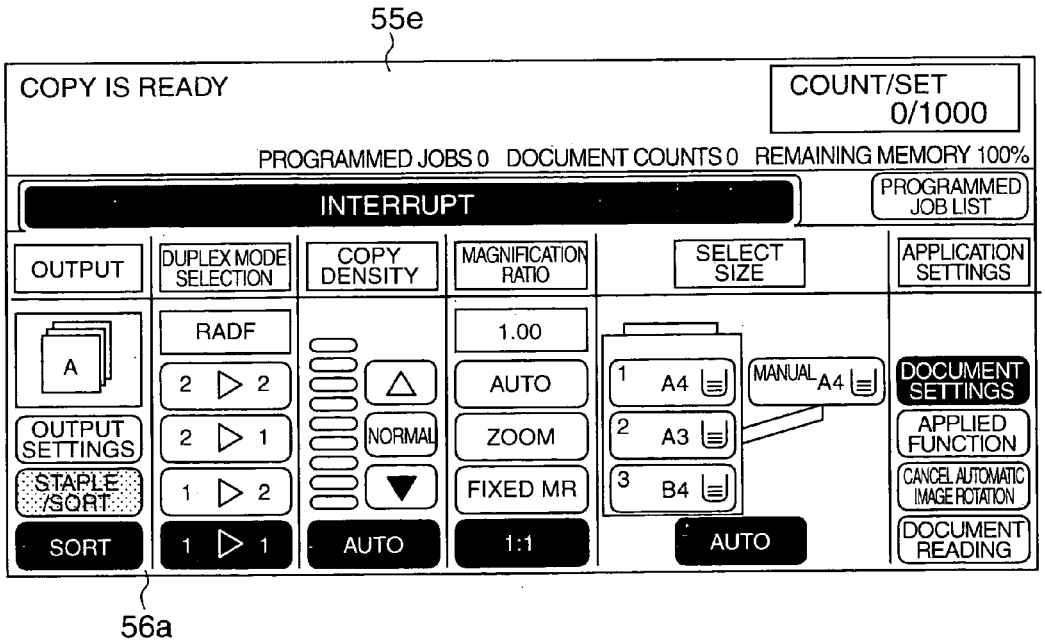
FIG. 15 is an illustration showing an example of the display of an interrupt copy setting screen that disables the selection of the staple mode.

When determining "the presence of paper P2 on the stacker 38" at step SB19, the control unit 43 causes an interrupt copy setting screen with the selection of the staple mode disabled, and displays it on the display part 52 (step SB21). FIG. 15 is an illustration showing another example of the interrupt copy setting screen in the second operation example. Since the control unit 43 has determined "the presence of paper on the stacker 38" at step SB19, if paper P2 for the interrupt job is sent to the stacker 38, it will be mixed up with those of paper P2 for the interrupted job. Therefore, the control unit 43 causes an interrupt copy setting screen 55*e* with the selection of the staple mode using the stacker 38 of the finisher 4 disabled, and displays it on the display part 52. In other words, the button to select the binding operation in the output form selection part 56*a* on the interrupt copy setting screen 55*e* is shown with half-tone dot meshing to indicate that the selection of this operation is disabled.

The user sees the interrupt copy setting screen 55*e* displayed on the display part 52 according to the detection results of the paper detection sensor 42 and the like, such as the presence or absence of paper P2, and selects an operation mode in the interrupt mode (step SB22). Then, the user presses the start button 54 (step SB23). When detecting "the press of the start button 54" at step SB23, the control unit 43 starts the interrupt copying operation according to the operation mode selected by the user at step SB22 (step SB24). In this copying operation, if an original P1 is placed on the contact glass 12, the control unit 43 controls the scanner section 5 to read an image of the original P1 on the contact glass 12 and the printer section 7 to perform printing. Further, when the ADF mode is selected and "the presence of one or more originals" on the document tray 30 is detected from the output of the document detection sensor 36 of the automatic document feeder 3, the control unit 43 controls the automatic document feeder 3 to perform the document feeding operation, while controlling the scanner section 5 to read images one by one from the originals P1 and the printer section 7 to perform printing. Further, when the staple mode is selected, the control unit 43 stacks a predetermined number of sheets of paper P2 on the stacker 38, staples the sheets together by means of the binder 39, and ejects the stack of paper into the main tray 40. After completion of the interrupt copying operation (step SB25), the control unit 43 continuously monitors the presence or absence of the press of the start button 54 (step SB26). When detecting "the press of the start button 54" at step SB26, the control unit 43 returns to step SB17.

When not detecting "the press of the interrupt button 53" at step SB17, the control unit 43 continues the printing operation of the interrupted job (step SB27). Then, after the completion of printing of a set number of copies (step SB28), the copying operation for the interrupted job is completed.

Figure 16:
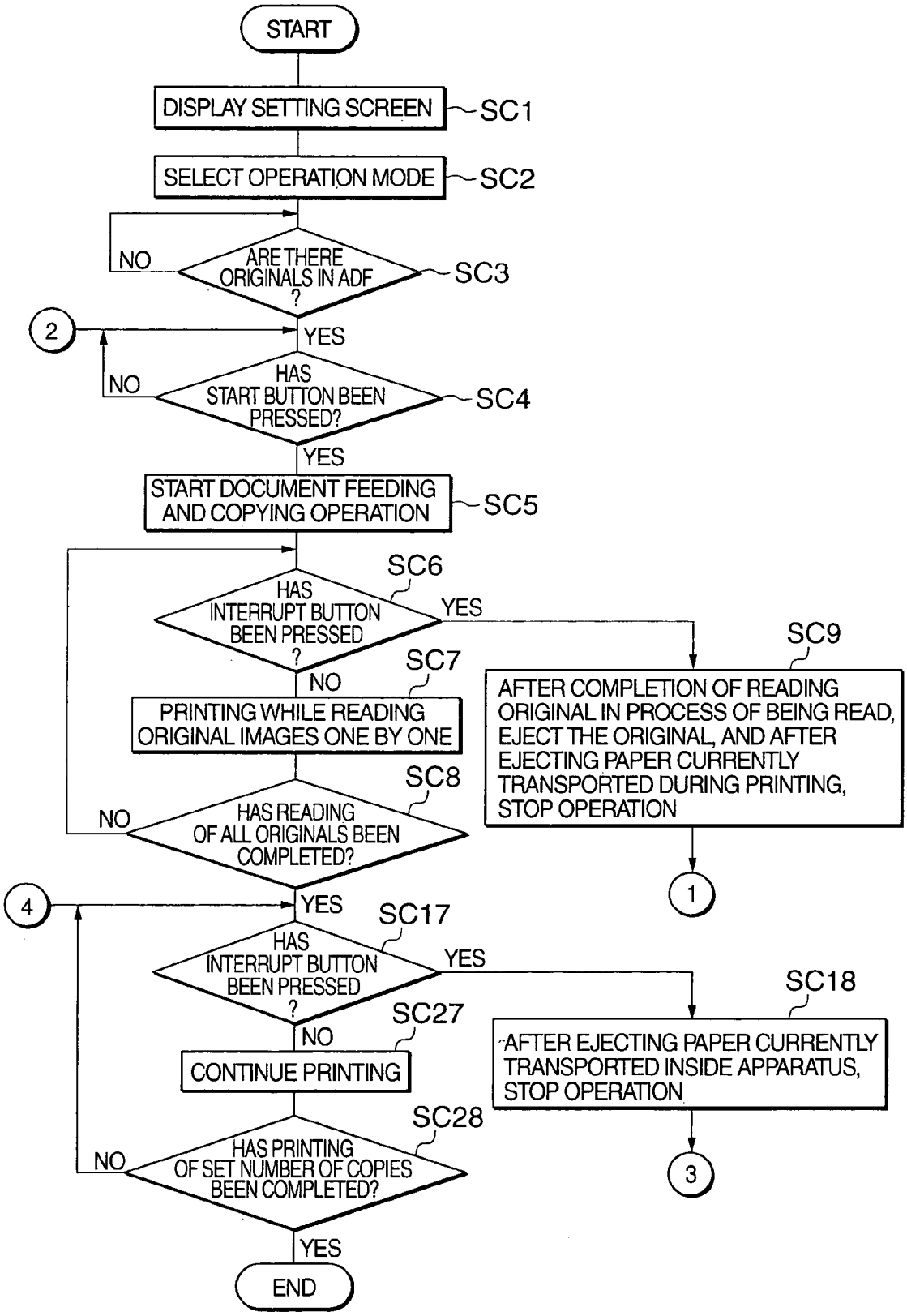
FIG. 16 is a flowchart showing a third operation example in the image forming apparatus of the present invention.
Figure 17:
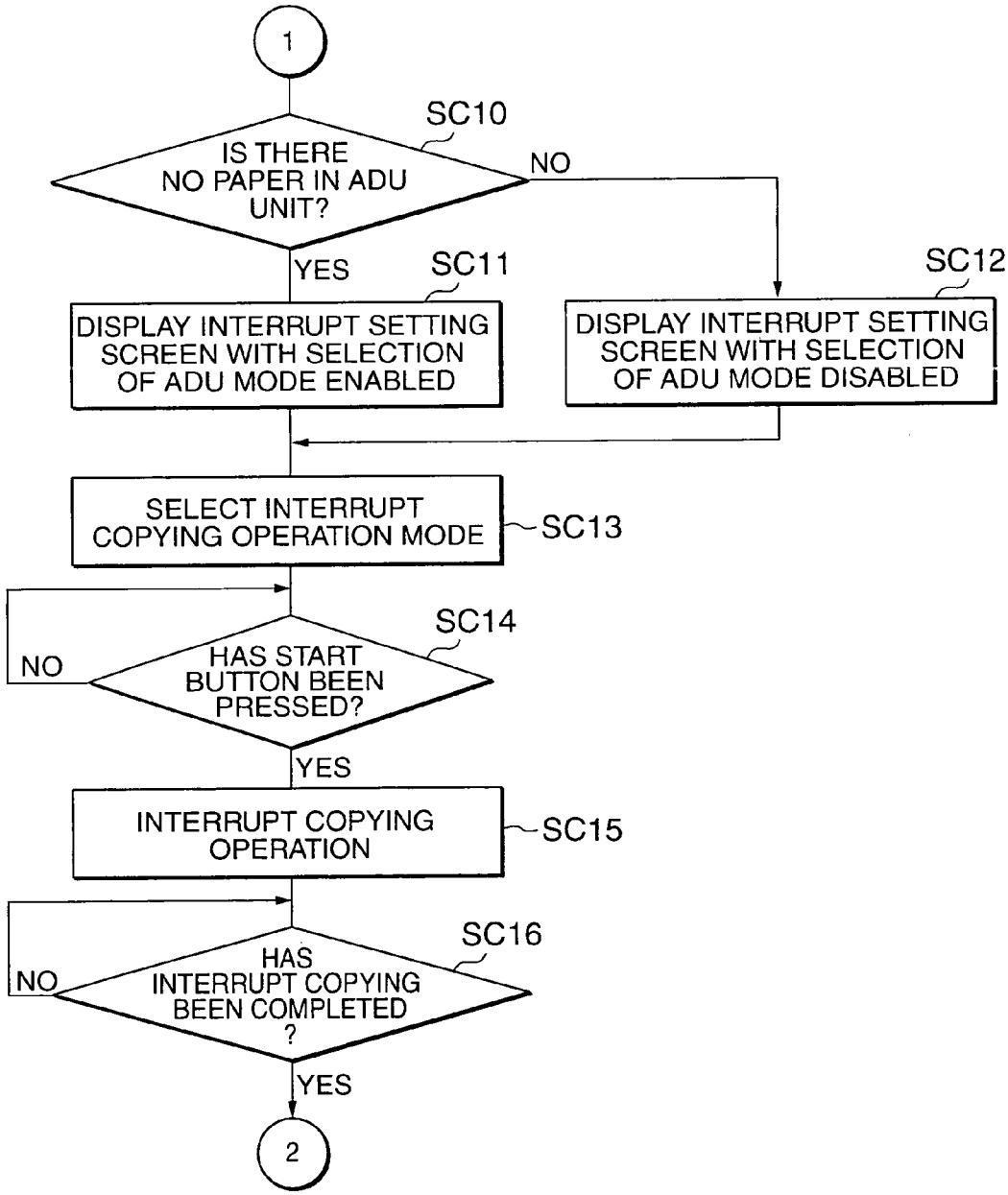
FIG. 17 is a flowchart continued from FIG. 16, showing the example of the third operation in the image forming apparatus of the present invention.
Figure 18:
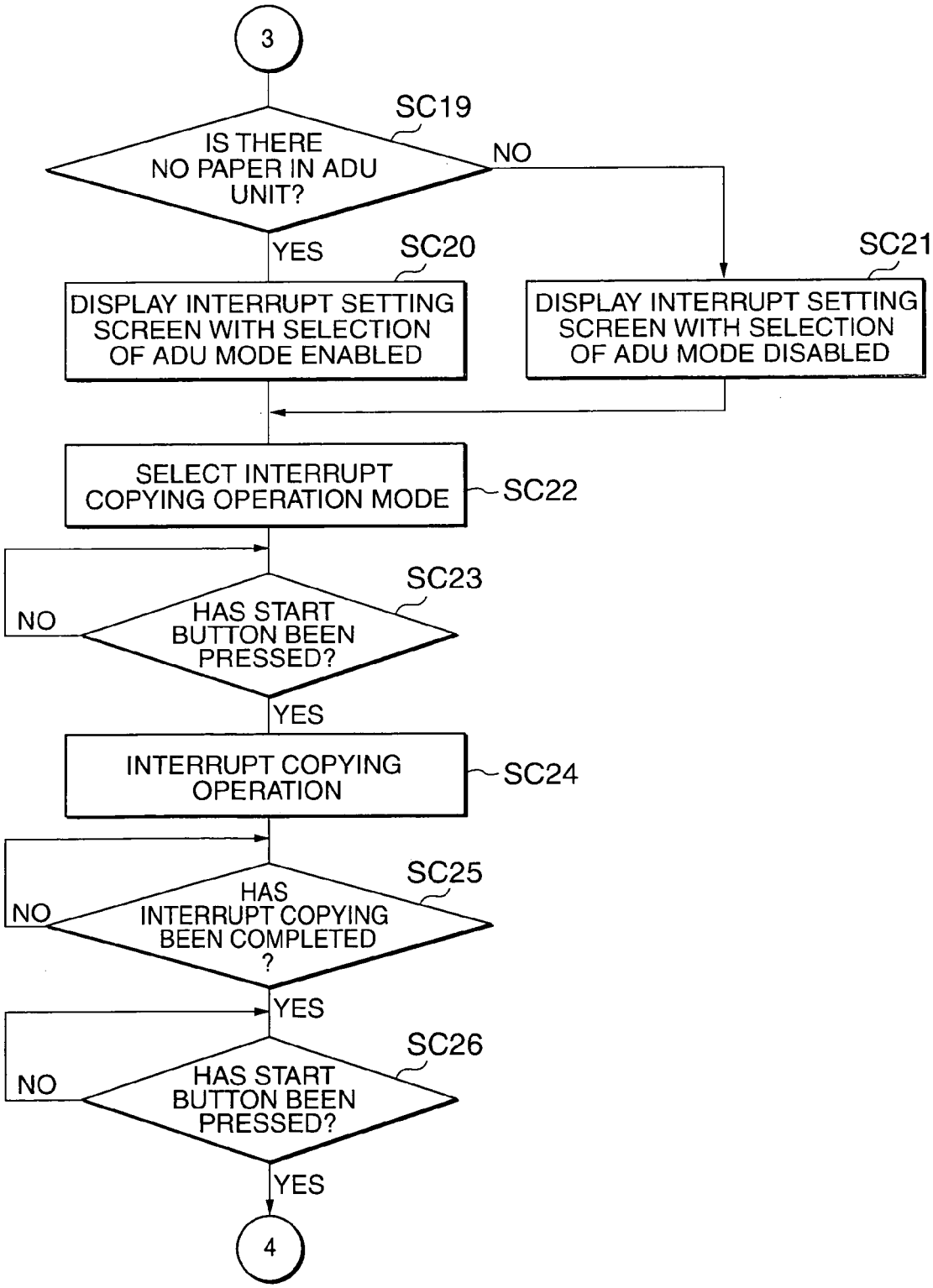
FIG. 18 is a flowchart continued from FIG. 16, showing the example of the third operation in the image forming apparatus of the present invention.

FIGS. 16 to 18 are flowcharts showing the third operation example of the image forming apparatus 1 of the present invention. The following description of the operation also refers to FIGS. 1 to 4 as appropriate. First, the control unit 43 causes the display of the setting screen 55*a* shown in FIG. 4 on the display part 52 of the operation unit 44 (step SC1). The user sees this setting screen 55*a* and selects a desired operation mode (step SC2). In the third operation example, suppose that the user has selected the ADU mode as such an operation mode as to read image data from one side of each of originals P1 and print the image data on both side of each sheet of paper P2.

When the user sets originals P1 on the document tray 30 of the automatic document feeder 3, the document detection sensor 36 detects "the presence of originals (step SC3). Then, when detecting "the press of the start button 54" (step SC4), the control unit 43 starts copying operation according to the operation mode selected by the user (step SC5). Further, the control unit 43 keeps track of whether the interrupt button 53 on the operation unit 44 is pressed or not (step SC6). When not detecting "the press of the interrupt button 53" at step SC6, the control unit 43 controls the paper feed actuator 48 to feed the originals P1 one by one, controls the scanner section 5 to read image data from each original P1, and controls the printer section 7 to print (or copy) the image data on each sheet of paper P2. In the ADU mode, paper P2 on one side of which printing has been done is sent to the reversing transport path to turn the paper P2 upside down. Then the paper P2 is sent to the printer section 7 again, thus performing double-sided printing (step SC7). The control unit 43 detects the presence or absence of originals from the outputs of the document detection sensor 36 and the document passing detection sensor 37 to determine whether the reading of all the originals P1 set on the document tray 30 has been completed (step SC8). In other words, when the document detection sensor 36 detects "no originals" and the document passing detection sensor 37 detects that "the rear end of the last original P1 has passed," the control unit 43 determines that the reading of all the originals P1 has been completed. On the other hand, when determining at step SC8 that the reading of all the originals P1 has not been completed yet, the control unit 43 returns to step SC6 to keep track of the presence or absence of the press of the interrupt button 53 while continuing the paper feeding and copying operations.

Then, when determining at step SC6 that "the interrupt button 53 has been pressed," the control unit 43 determines, from the output of the document passing detection sensor 37, the presence or absence of any original P1 that is in the process of being read. When the control unit 43 determines that "there is an original P1 in the process of being read," the transportation and reading of the original P1 in process are continued. Then, when the document passing detection sensor 37 detects that "the rear end of the original P1 has passed," the control unit 43 inhibits further feeding.

The control unit 43 also determines, from the output of the sensor group 45 and the like, the presence or absence of paper P2 in the process of printing on it. Then, after a sheet of paper P2 is pulled out from one of the paper feed cassettes 17, when the control unit 43 determines that "there is paper P2 in the process of printing on it" in the transport path, the transportation of and printing on the paper P2 are continued. Finally, the paper P2 on which printing has been done is ejected into the sub-tray 41 and further printing is inhibited (step SC9).

Next, the control unit 43 determines the presence or absence of paper P2 in the reversing unit 10 from the output of the paper detection sensor 29 of the reversing unit 10 (step SC10). When determining "no paper P2 in the reversing unit 10" at step SC10, the control unit 43 causes the display of the interrupt copy setting screen 55*b* shown in FIG. 9 on the display part 52 (step SC11).

In other words, since the control unit 43 has determined at step SC10 "no paper in the reversing unit 10," the paper P2 can be stacked in the reversing unit 10 without being mixed up with paper P2 for the interrupted job. Therefore, the control unit 43 causes the interrupt copy setting screen 55*b* with "the selection of the ADU mode enabled" as an operation mode using the reversing unit 10, and displays it on the display part 52. When "the press of the interrupt button 53" is detected at step SC6, since it means that the reading operation was halted with one or more unread originals P1 remaining on the document tray 30 of the automatic document feeder 3, the document detection sensor 36 detects "the presence of one or more originals." Thus the selection of the ADF mode using the automatic document feeder 3 is disabled. In other words, the buttons to select the double-sided reading of originals p1 in the duplex mode selection part 56*b* on the interrupt copy setting screen 55*b* are shown with half-tone dot meshing to indicate that the selection of these operations is disabled.

Figure 19:
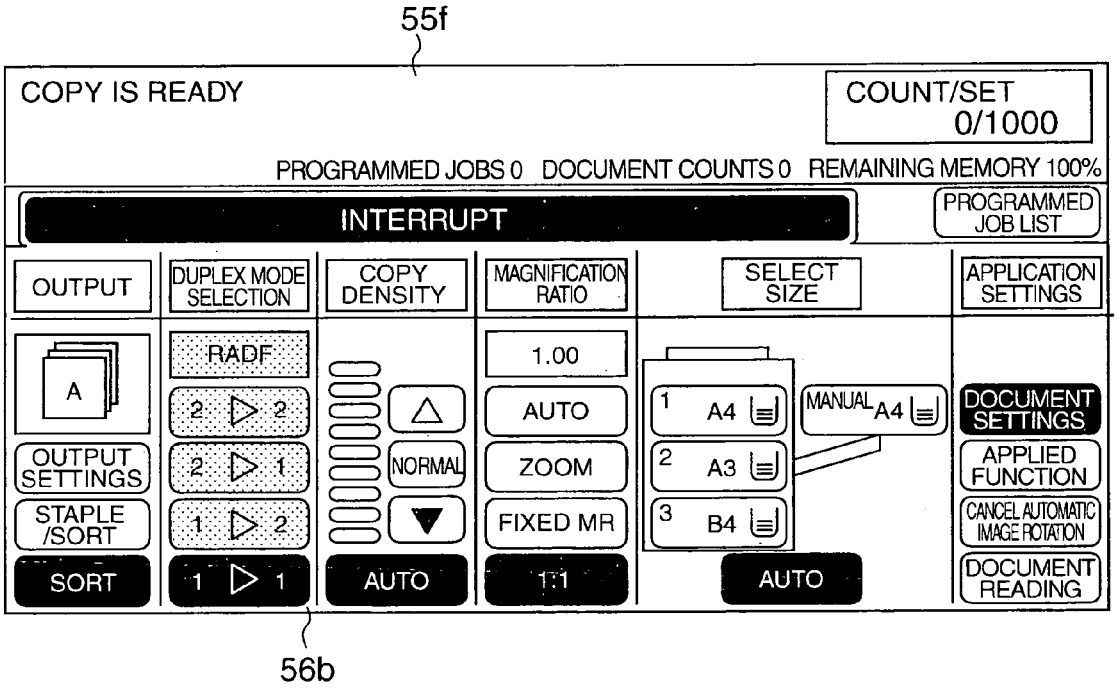
FIG. 19 is an illustration showing an example of the display of an interrupt copy setting screen that disables the selection of ADU and ADF modes.

On the other hand, when determining at step SC10 that "there is paper P2 in the reversing unit 10," the control unit 43 causes an interrupt copy setting screen with the selection of the ADU mode disabled, and displays it on the display part 52 (step SC12). FIG. 19 is an illustration showing an example of the interrupt copying setting screen. Since the control unit 43 has determined "the presence of paper in the reversing unit 10" at step SC10, if paper P2 for the interrupt job is sent to the reversing unit, it will be mixed up with those of paper P2 for the interrupted job. Therefore, the control unit 43 causes an interrupt copy setting screen 55*f* with the selection of the ADU mode disabled, as an operation mode using the reversing unit 10, and displays it on the display part 52. In other words, the buttons to select the double-sided printing on paper P2 in the duplex mode selection part 56*b* on the interrupt copy setting screen 55*f* are shown with half-tone dot meshing to indicate that the selection of these operations is disabled. As shown on the interrupt copy setting screen 55*f* of FIG. 19, the ADF mode is also disabled in response to the processing step SC12 the reason why the selection of the ADF mode is also disabled in response to the processing step SC12 is that, as mentioned above, the reading operation was halted with one or more unread originals P1 remaining on the document tray 30 of the automatic document feeder 3.

The user sees the interrupt copy setting screen 55*f* displayed on the display part 52 according to the detection results of the paper detection sensor 42 and the like, such as the presence or absence of paper P2, and selects an operation mode in the interrupt mode (step SC13). Then, the user places an original P1 on the contact glass 12 and presses the start button 54 (step SC14). When detecting "the press of the start button 54" at step SC14, the control unit 43 starts the interrupt copying operation according to the operation mode selected by the user at step SC13 (step SC15). In this copying operation, even if detecting that "there is one or more originals" on the document tray 30 from the output of the document detection sensor 36 of the automatic document feeder 3, the control unit 43 inhibits the automatic document feeder 3 from performing the document feeding operation. Instead, the control unit 43 controls the scanner section 5 to read an image of the original P1 on the contact glass 12 and the printer section 7 to perform printing. After completion of the interrupt copying operation (step SC16), the control unit 43 returns to step SC4, and when detecting "the press of the start button 54" at step SC4, it resumes the interrupted job.

After that, when determining "the completion of reading image data of all the originals P1" at step SC8, the control unit 43 continuously monitors the presence or absence of the press of the interrupt button 53 during printing operation (step SC17). Then, when detecting "the press of the interrupt button 53" at step SC17, the control unit 43 determines, from the output of the sensor group 45 and the like, the presence or absence of paper P2 in the process of printing on it.

Then, after a sheet of paper P2 is pulled out from one of the paper feed cassettes 17, when the control unit 43 determines that "there is paper P2 in the process of printing on it" in the transport path, the transportation of and printing on the paper P2 are continued. Finally, the paper P2 on which printing has been done is ejected into the sub-tray 41 and further printing is inhibited (step SC18).

Next, the control unit 43 determines the presence or absence of paper P2 in the reversing unit 10 from the detection result of the paper detection sensor 29 of the reversing unit (step SC19). When determining "no paper P2 in the reversing unit 10" at step SC19, the control unit 43 causes the display of the interrupt copy setting screen 55*c* shown in FIG. 10 on the display part 52 (step SC20).

In other words, since the control unit 43 has determined at step SC19 "no paper in the reversing unit 10," the paper P2 can be stacked in the reversing unit 10 without being mixed up with paper P2 for the interrupted job. Therefore, the control unit 43 causes the interrupt copy setting screen 55*c* with "the selection of the ADU mode enabled" as an operation mode using the reversing unit 10, and displays it on the display part 52. When the press of the interrupt button 53 is detected at step SC17, since no originals P1 remain on the document tray 30 of the automatic document feeder 3, the document detection sensor 36 detects "the absence of originals." Thus the selection of the ADF mode is also enabled. In other words, all the buttons in the output form selection part 56*a* and the duplex mode selection part 56*b* on the interrupt copy setting screen 55*c* are activated and become selectable.

On the other hand, when determining at step SC19 that "there is paper P2 in the reversing unit 10," the control unit 43 causes an interrupt copy setting screen with the selection of the ADU mode disabled, and displays it on the display part 52 (step SC21).

Figure 20:
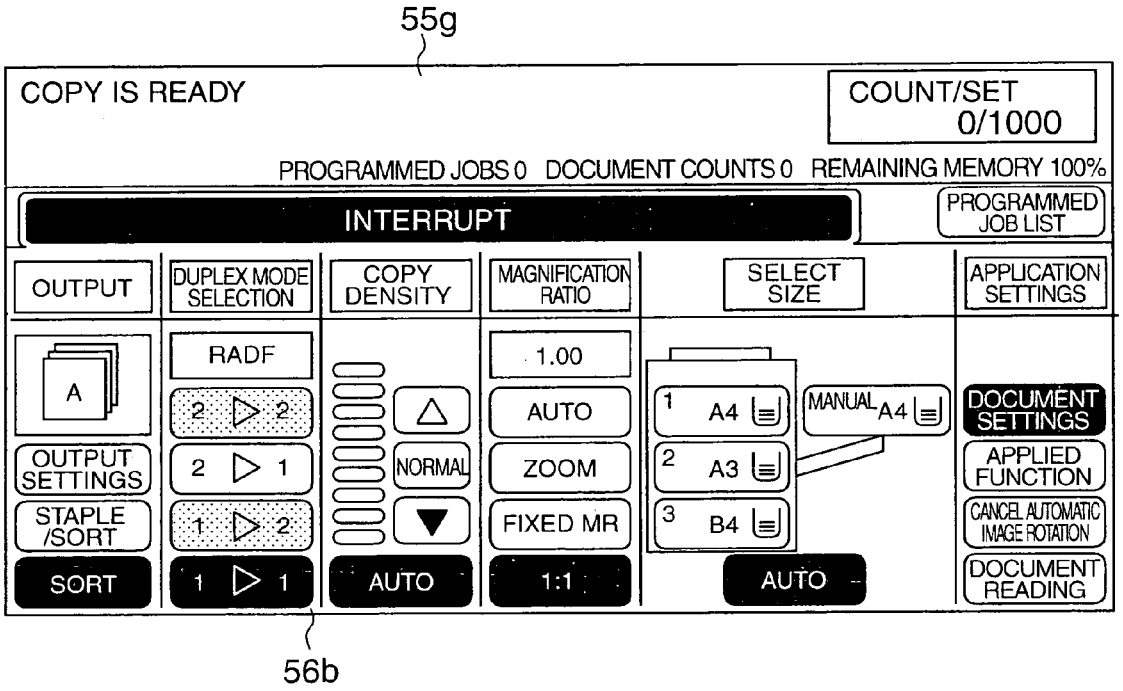
FIG. 20 is an illustration showing an example of the display of an interrupt copy setting screen that disables the selection of the ADU mode.

FIG. 20 is an illustration showing still another example of the interrupt copying setting screen. Since the control unit 43 has determined "the presence of paper in the reversing unit 10" at step SC19, if paper P2 for the interrupt job is sent to the reversing unit 10, it will be mixed up with those of paper P2 for the interrupted job. Therefore, the control unit 43 causes an interrupt copy setting screen 55*g* with the selection of the ADU mode disabled, as an operation mode using the reversing unit 10, and displays it on the display part 52. In other words, the buttons to select the double-sided printing of paper P2 in the duplex mode selection part 56*b* on the interrupt copy setting screen 55*g* are shown with half-tone dot meshing to indicate that the selection of these operations is disabled.

The user sees the interrupt copy setting screen 55*g* displayed on the display part 52 according to the detection results of the paper detection sensor 42 and the like, such as the presence or absence of paper P2, and selects an operation mode in the interrupt mode (step SC22). Then, the user presses the start button 54 (step SC23). When detecting "the press of the start button 54" at step SC23, the control unit 43 starts the interrupt copying operation according to the operation mode selected by the user at step SC22 (step SC24). In this copying operation, if an original P1 is placed on the contact glass 12, the control unit 43 controls the scanner section 5 to read an image of the original P1 on the contact glass 12 and the printer section 7 to perform printing. Further, when the ADF mode is selected and the presence of one or more originals on the document tray 30 is detected from the output of the document detection sensor 36 of the automatic document feeder 3, the control unit 43 controls the automatic document feeder 3 to perform the document feeding operation, while controlling the scanner section 5 to read images one by one from the originals P1 and the printer section 7 to perform printing. Further, when the ADU mode is selected, paper P2 on one side of which printing has been done is sent to the reversing transport path 27 to turn the paper P2 upside down. Then the paper P2 is sent to the printer section 7 again, thus performing double-sided printing. After completion of the interrupt copying operation (step SC25), the control unit 43 continuously monitors the presence or absence of the press of the start button 54 (step SC26). When detecting "the press of the start button 54" at step SC26, the control unit 43 returns to step SC17.

When not detecting "the press of the interrupt button 53" at step SC17, the control unit 43 continues the printing operation of the interrupted job (step SC27). Then, after completion of printing of a set number of copies (step SC28), the copying operation of the interrupted job is completed.

Figure 21:
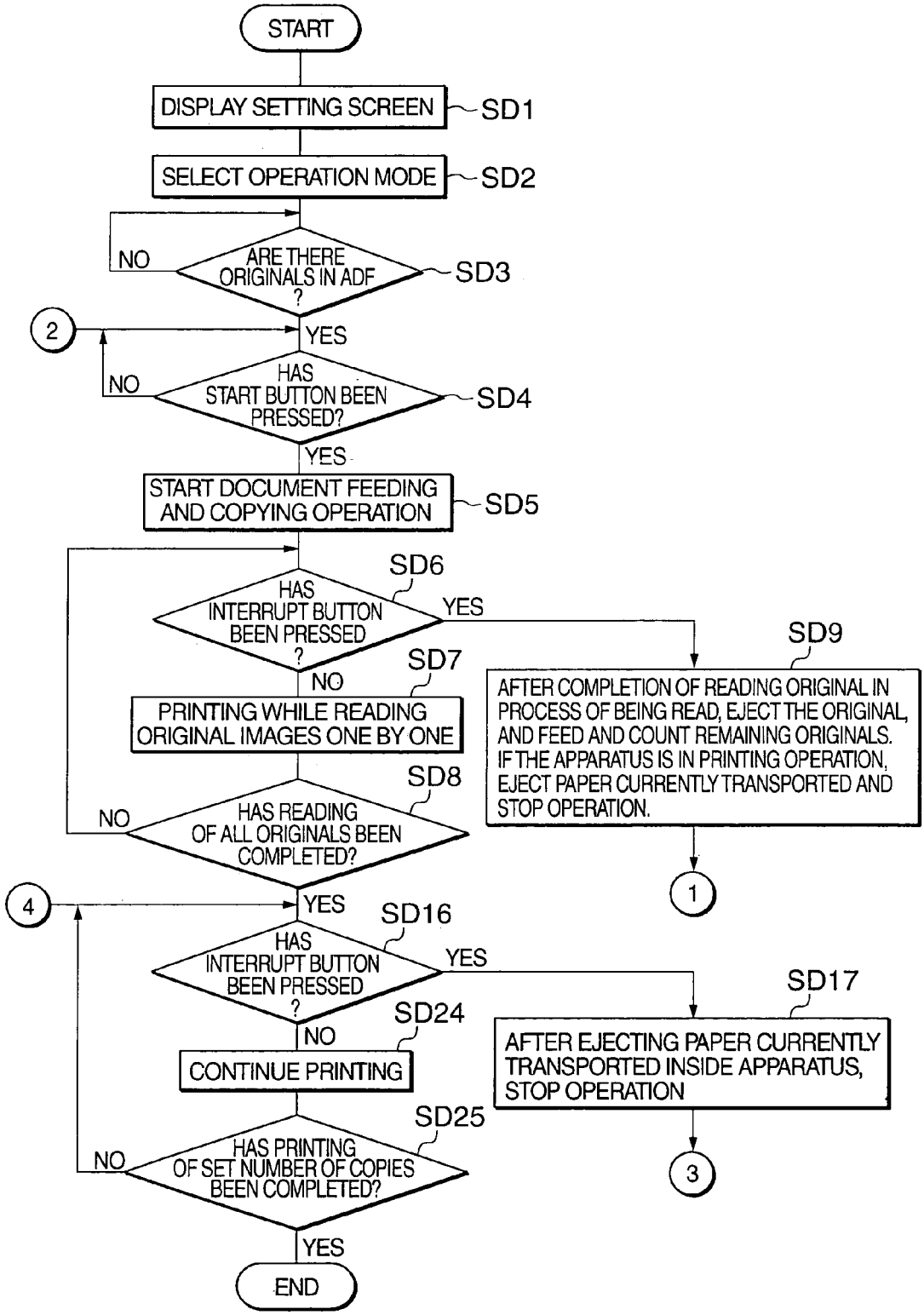
FIG. 21 is a flowchart showing a fourth operation example in the image forming apparatus of the present invention.
Figure 22:
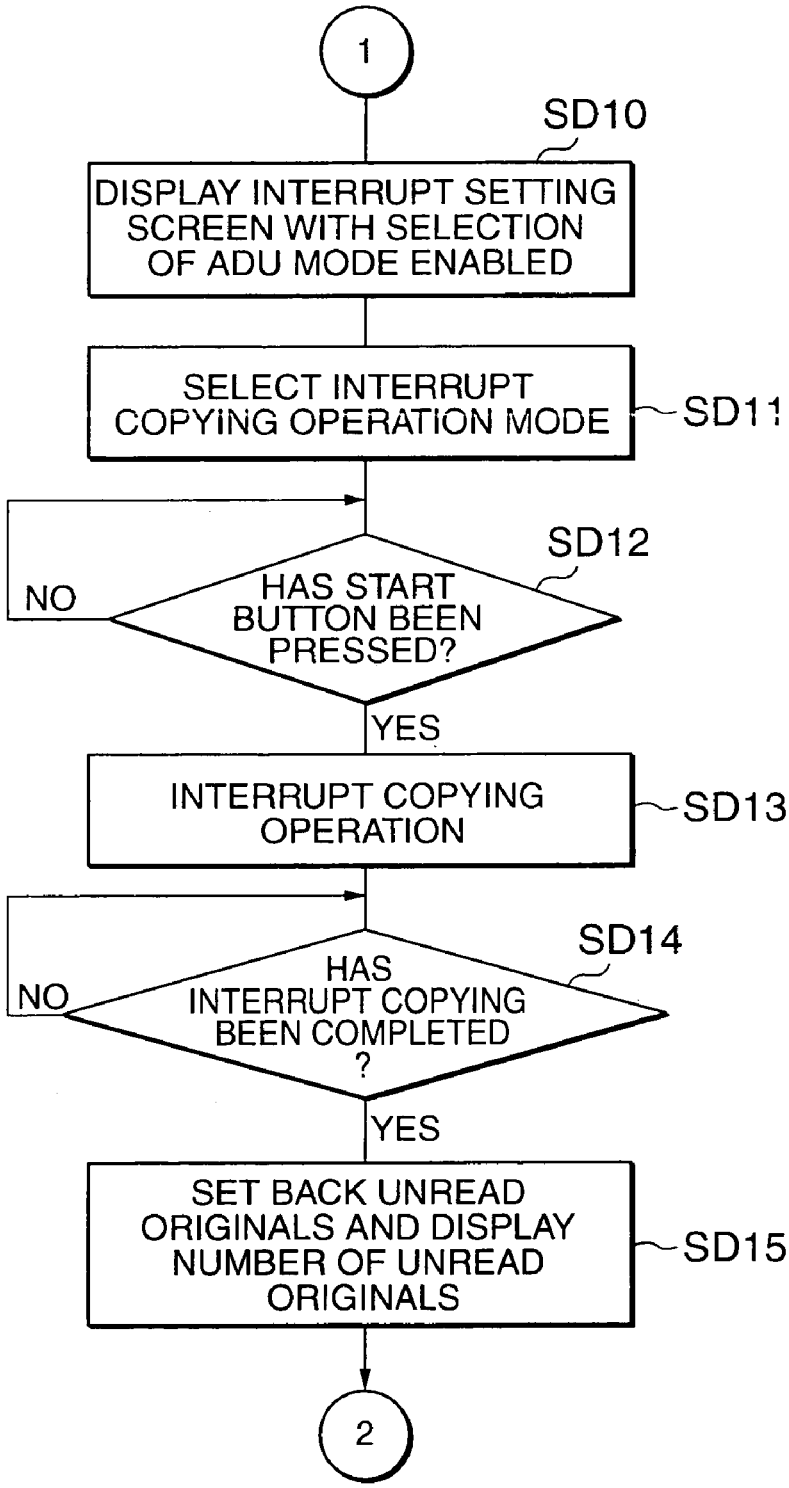
FIG. 22 is a flowchart continued from FIG. 21, showing the example of the fourth operation in the image forming apparatus of the present invention.
Figure 23:
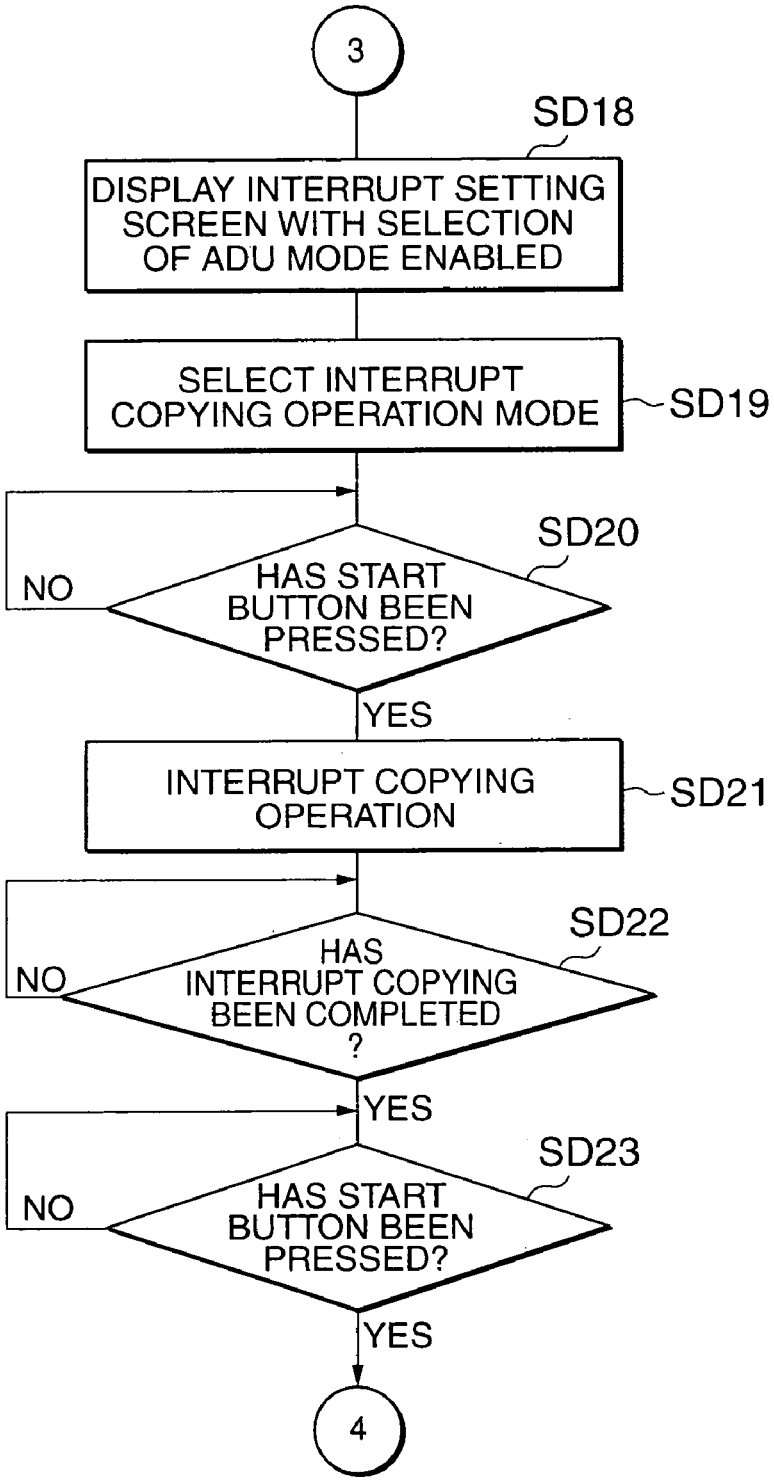
FIG. 23 is a flowchart continued from FIG. 21, showing the example of the fourth operation in the image forming apparatus of the present invention.

FIGS. 21 to 23 are flowcharts showing the fourth operation example of the image forming apparatus 1 of the present invention. The fourth operation example shows a case where the interrupt mode to interrupt operation halfway through making the required number of copies is selected as the initial setting. First, the control unit 43 causes the display of the setting screen 55*a,* shown in FIG. 4, on the display part 52 of the operation unit 44 (step SD1). The user sees this setting screen 55*a* and selects a desired operation mode (step SD2). In the fourth operation example, suppose that the user has selected such an operation mode as to read image data from one side of each of originals P1, print the image data on one side of each sheet of paper P2, and output the sheets of paper P2 without being stapled. When the user sets originals P1 on the document tray 30 of the automatic document feeder 3, the document detection sensor 36 detects "the presence of originals (step SD3). When detecting "the press of the start button 54" on the operation unit 44 (step SD4), the control unit 43 starts copying operation according to the operation mode selected by the user (step SD5). The control unit 43 also monitors the presence or absence of the press of the interrupt button 53 on the operation unit 44 (step SD6). When not detecting "the press of the interrupt button 53" at step SD6, the control unit 43 controls the paper feed actuator 48 to feed the originals P1 one by one, controls the scanner section 5 to read image data from each original P1, and controls the printer section 7 to print (or copy) the image data on each sheet of paper P2 (step SD7).

The control unit 43 detects the presence or absence of originals from the outputs of the document detection sensor 36 and the document passing detection sensor 37 to determine whether the reading of all the originals P1 set on the document tray 30 has been completed (step SD8). In other words, when the document detection sensor 36 detects no originals and the document passing detection sensor 37 detects that the rear end of the last original P1 has passed, the control unit 43 determines that the reading of all the originals P1 has been completed. On the other hand, when determining at step SD8 that the reading of all the originals P1 has not been completed yet, the control unit 43 returns to step SD6 to keep track of the presence or absence of the press of the interrupt button 53 while continuing the paper feeding and copying operations.

Then, when determining at step SD6 that the interrupt button 53 has been pressed, the control unit 43 determines, from the output of the document passing detection sensor 37, the presence or absence of any original P1 that is in the process of being read. When the control unit 43 determines that "there is an original P1 in the process of being read," the transportation and reading of the original P1 in process are continued. Further, the control unit 43 controls the paper feed actuator 48 to feed to the output tray 31 the originals P1 subsequent to the one being currently read and remaining on the document tray 30, and counts and stores the number of paper feeds from the output of the document passing detection sensor 37. This paper feeding does not involve reading of image data. Then, when the document passing detection sensor 37 detects that the rear end of the last original P1 has passed, the control unit 43 inhibits further feeding.

The control unit 43 also determines, from the output of the sensor group 45 and the like, the presence or absence of paper P2 in the process of printing on it. Then, after a sheet of paper P2 is pulled out from one of the, paper feed cassettes 17, when the control unit 43 determines that there is paper P2 in the process of printing on it, the transportation of and printing on the paper P2 are continued. Finally, the paper P2 on which printing has been done is ejected into the sub-tray 41 and further printing is inhibited (step SD9).

Next, the control unit 43 causes the display of the predetermined interrupt copy setting screen 55*c* shown in FIG. 10 on the display part 52 (step SD10). In other words, when the press of the interrupt button 53 is detected at step SD6, since all the originals P1 are ejected from the document tray 30 of the automatic document feeder 3 into the output tray 31 at step SD9, no originals P1 remain on the document tray 30 and the document detection sensor 36 detects no originals. Thus the selection of the ADF mode is enabled. In other words, all the buttons in the duplex mode selection part 56*b* on the interrupt copy setting screen 55*c* are activated and become selectable.

The user sees the interrupt copy setting screen 55*c* shown in FIG. 10 on the display part 52 and selects an operation mode in the interrupt mode (step SD11). Then, the user presses the start button 54 (step SD12). When detecting "the press of the start button 54" at step SD12, the control unit 43 starts the interrupt copying operation according to the operation mode selected by the user at step SD11 (step SD13). In this copying operation, if an original P1 is placed on the contact glass 12, the control unit 43 controls the scanner section 5 to read an image of the original P1 on the contact glass 12 and the printer section 7 to perform printing. Further, when detecting "the presence of one or more originals" on the document tray 30 from the output of the document detection sensor 36 of the automatic document feeder 3, the control unit 43 controls the automatic document feeder 3 to perform the document feeding operation, while controlling the scanner section 5 to read images one by one from the originals and the printer section 7 to perform printing. After completion of the interrupt copying operation (step SD14), the control unit 43 causes the display of data on the number of unread originals stored at step SD9, and displays it on the display part 52 as data on the number of originals to be sent back to the automatic document feeder 3 (step SD15). After displaying at step SD15 the data on the number of originals to be sent back, the control unit 43 returns to step SD3 to keep track of the output of the document detection sensor 36 so as to determine whether the originals P1 are set again on the document tray 30. Then, when detecting the presence of the originals at step SD3 and the press of the start button 54 at step SD4, the control unit 43 resumes the interrupted job.

After that, when determining the completion of reading image data of all the originals P1 at step SD8, the control unit 43 continuously monitors the presence or absence of the press of the interrupt button 53 during printing operation (step SD16). Then, when detecting the press of the interrupt button 53 at step SD16, the control unit 43 determines, from the output of the sensor group 45 and the like, the presence or absence of paper P2 in the process of printing on it. When determining that there is a sheet of paper P2 in the process of printing on it after pulled out from one of the paper feed cassettes 17, the control unit 43 continues the transportation of and printing on the paper P2 in process. Then, after the paper P2 on which printing has been done is ejected into the sub-tray 41, the control unit 43 inhibits further printing (step SD17).

Next, the control unit 43 causes the display of the interrupt copy setting screen 55*c* shown in FIG. 10 on the display part 52 (step SD18). The user sees the interrupt copy setting screen 55*c* shown in FIG. 10 and displayed on the display part 52, and selects an operation mode in the interrupt mode (step SD19). Then, the user presses the start button 54 (step SD20). When detecting "the press of the start button 54" at step SD20, the control unit 43 starts the interrupt copying operation according to the operation mode selected by the user at step SD19 (step SD21). After completion of the interrupt copying operation (step SD22), the control unit 43 continuously monitors the presence or absence of the press of the start button 54 (step SD23). Then, when detecting "the press of the start button 54" at step Sd23, the control unit 43 returns to step SA16.

When not detecting "the press of the interrupt button 53" at step SD16, the control unit 43 continues the printing operation of the interrupted job (step SD24). Then, after the completion of printing of a set number of copies (step SD25), the copying operation for the interrupted job is completed.

Although not shown here, if the staple mode or ADU mode is selected for the interrupted job in the fourth operation example, the control unit 43 will determine selectable operation modes in response to the press of the interrupt button 53 according to the detection results of the paper detection sensors 29 and 45, such as the presence or absence of paper.

In the fourth operation example, if the interrupted job is in the ADF mode, since the originals P1 for the interrupted job are made to retreat from the document tray 30, the ADF mode is selectable in the interrupt mode regardless of the timing of interruption. Thus the number of selectable operation modes can be increased.

INDUSTRIAL APPLICABILITY

The present invention can be applied to image forming apparatuses called all-in-one or multifunctional machines that combine functions such as a copier, printer, facsimile, etc.

What is claimed is:

1. An image forming apparatus comprising:

automatic document feeding means for placing multiple originals in position and feeding the originals one by one;

document reading means;

printing means for printing on paper image data acquired by said reading means;

document detecting means, provided in said automatic document feeding means, for detecting the originals;

paper detecting means for detecting paper;

operation means for capturing user's operations; and control means for receiving an interrupt operation instruction given by the user through said operation means, determining executable operation modes according to the transport states of the originals and paper detected by said document detecting means and said paper detecting means, and outputting the executable operation mode selected through said operation means.

2. The apparatus according to claim 1, wherein when an interrupt operation is instructed by the user while the originals are being fed by said automatic document feeding means, said control means completes the reading of the original being currently fed and stops the feeding of the following originals.

3. The apparatus according to claim 1, wherein when determining that there are no originals in said automatic document feeding means based on the detection result of said document detecting means, said control means enables the selection of an operation mode using said automatic document feeding means, while when determining there is one or more originals in said automatic document feeding means, said control means disables the selection of the operation mode using said automatic document feeding means.

4. The apparatus according to claim 1, wherein when an interrupt operation is instructed by the user while the originals are being fed by said automatic document feeding means, said control means not only completes the reading of the original being currently fed, but also feeds the following originals while counting the number of unread originals, and when determining that there are no originals in said automatic document feeding means based on the detection result of said document detection means, said control means enables the selection of an operation mode using said automatic document feeding means and outputs all pieces of originals corresponding to the number of unread originals to said operation means after completion of the interrupt operation.

5. The apparatus according to claim 1 further comprising post processing means including at least stacking means for stacking sheets of paper on which printing have been done through said printing means, and binding means for binding the sheets of paper stacked on said stacking means, wherein said paper detection means detects the presence or absence of paper in said post processing means, and when determining no paper in said post processing means based on the detection result of said paper detection means, said control means enables the selection of an operation mode using said post processing means, while when determining there is one or more sheets of paper in said post processing means, said control means disables the selection of the operation mode using said post processing means.

6. The apparatus according to claim 1 further comprising reversing means for turning the paper upside down, wherein said paper detection means detects the presence or absence of paper in said reversing means, and when determining no paper in said reversing means based on the detection result of said paper detection means, said control means enables the selection of an operation mode using said reversing means, while when determining there is one or more sheets of paper in said reversing means, said control means disables the selection of the operation mode using said reversing means.

* * * * *